US012753675B2

(12) United States Patent
Butler et al.

(10) Patent No.: US 12,753,675 B2
(45) **Date of Patent: *Oct. 6, 2026**

(54) SLIDABLE ISOLATION SLEEVE WITH I-SHAPED SEAL

(71) Applicant: Halliburton Energy Services, Inc., Houston, TX (US)

(72) Inventors: Benjamin Butler, North Perth (AU); Leonque Jose Rondon, Maturin (VE); David Joe Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/404,388

(22) Filed: Jan. 4, 2024

(65) Prior Publication Data

US 2024/0151120 A1 May 9, 2024

Related U.S. Application Data

(63) Continuation of application No. 17/537,051, filed on Nov. 29, 2021, now Pat. No. 11,867,030.

(51) Int. Cl.

| | |
|---|---|
| ***E21B 41/00*** | (2006.01) |
| ***E21B 7/06*** | (2006.01) |
| ***E21B 23/08*** | (2006.01) |

(52) U.S. Cl.

CPC ..... *E21B 41/0042* (2013.01); *E21B 7/061* (2013.01); *E21B 23/08* (2013.01)

(58) Field of Classification Search

CPC ..... E21B 33/047; E21B 33/1208; E21B 41/0042; E21B 7/061; E21B 23/08

See application file for complete search history.

(56) References Cited

U.S. PATENT DOCUMENTS

| | | | |
|---|---|---|---|
| 4,471,965 | A | 9/1984 | Jennings et al. |
| 4,573,529 | A | 3/1986 | Reinhardt |
| 5,730,224 | A | 3/1998 | Williamson et al. |

(Continued)

FOREIGN PATENT DOCUMENTS

| | | | |
|---|---|---|---|
| CN | 115906318 A | * | 4/2023 |
| EP | 0792997 A2 | | 9/1997 |

(Continued)

*Primary Examiner* — Dany E Akakpo

(74) *Attorney, Agent, or Firm* — Scott Richardson; Parker Justiss, P.C.

(57) ABSTRACT

Provided is a downhole tool. The downhole tool, in one aspect, includes an isolation system for placement at a junction between a first wellbore and a secondary wellbore. In at least one aspect, the isolation system includes an elongated tubular, the elongated tubular having an opening connecting an interior of the elongated tubular and an exterior of the elongated tubular; and a slot located in the elongated tubular, the slot spanning the opening. In at least one aspect, the isolation system further includes an isolation sleeve located within the isolation system, the isolation sleeve configured to slide within the slot to either isolate the interior of the elongated tubular from the exterior of the elongated tubular or provide access between the interior of the elongated tubular and the exterior of the elongated tubular, and an I-shaped seal located in an annulus between the elongated tubular and the isolation sleeve.

21 Claims, 18 Drawing Sheets

(56) References Cited

U.S. PATENT DOCUMENTS

| | | | | |
|---|---|---|---|---|
| 6,079,493 | A | 6/2000 | Longbottom et al. | |
| 6,095,248 | A | 8/2000 | Freeman | |
| 6,209,648 | B1 | 4/2001 | Ohmer et al. | |
| 8,894,070 | B2 | 11/2014 | Bhat et al. | |
| 8,899,691 | B2 | 12/2014 | Day et al. | |
| 2001/0009189 | A1 | 7/2001 | Brooks et al. | |
| 2009/0194945 | A1 | 8/2009 | Bhat et al. | |
| 2018/0187519 | A1 | 7/2018 | Rodriguez et al. | |
| 2018/0283140 | A1 | 10/2018 | Steele | |
| 2018/0313156 | A1 | 11/2018 | Steele et al. | |
| 2021/0010349 | A1 | 1/2021 | Steele | |
| 2021/0010350 | A1 | 1/2021 | Steele | |
| 2022/0381108 | A1 | 12/2022 | Murphy et al. | |
| 2022/0412198 | A1 * | 12/2022 | Steele | E21B 41/0042 |

FOREIGN PATENT DOCUMENTS

| | | | | | |
|---|---|---|---|---|---|
| GB | 2283518 | A | * | 5/1995 | E21B 33/10 |
| WO | 2009099433 | A1 | | 8/2009 | |
| WO | 2019112613 | A1 | | 6/2019 | |

* cited by examiner

SLIDABLE ISOLATION SLEEVE WITH I-SHAPED SEAL

CROSS-REFERENCE TO RELATED APPLICATION

This application is a continuation of U.S. patent application Ser. No. 17/537,051, entitled "SLIDABLE ISOLATION SLEEVE WITH I-SHAPED SEAL", filed on Nov. 29, 2021. The above-listed application is commonly assigned with the present application and is incorporated herein by reference as if reproduced herein in its entirety.

BACKGROUND

In the production of hydrocarbons, it is common to drill one or more secondary wellbores from a first wellbore. Typically, the first and secondary wellbores, collectively referred to as a multilateral wellbore, will be drilled and cased using a drilling rig. Thereafter, once completed, the drilling rig will be removed, and the wellbores will produce hydrocarbons.

During any stage of the life of a wellbore, various treatment fluids may be used to stimulate the wellbore. As used herein, the term "treatment," or "treating," refers to any subterranean operation that uses a fluid in conjunction with a desired function and/or for a desired purpose. The term "treatment," or "treating," does not imply any particular action by the fluid or any particular component of the fluid.

One common stimulation operation that employs a treatment fluid is hydraulic fracturing. Hydraulic fracturing operations generally involve pumping a treatment fluid (e.g., a fracturing fluid) into a wellbore that penetrates a subterranean formation at a sufficient hydraulic pressure to create one or more cracks, or "fractures," in the subterranean formation through which hydrocarbons will flow more freely. In some cases, hydraulic fracturing can be used to enhance one or more existing fractures. "Enhancing" one or more fractures in a subterranean formation, as that term is used herein, is defined to include the extension or enlargement of one or more natural or previously created fractures in the subterranean formation. "Enhancing" may also include positioning material (e.g., proppant) in the fractures to support ("prop") them open after the hydraulic fracturing pressure has been decreased (or removed).

During the initial production life of a wellbore—often called the primary phase—primary production of hydrocarbons typically occurs either under natural pressure, or by means of pumps that are deployed within the wellbore. This may include wellbores that have undergone stimulation operations, such a hydraulic fracturing, during a completion process. Unconventional wells typically will not produce economical amounts oil or gas unless they are stimulated via a hydraulic fracturing process to enhance and connect existing fractures. In order to reduce well costs, the hydraulic fracturing process is performed after the drilling rig has been removed from the well. Furthermore, wells may be hydraulically fractured without the aid of a workover rig if the equipment used to fracture a well is light enough to be transported in and out of the wellbore via a coiled tubing unit, wireline, electric line, or other device.

Over the life of a wellbore, the natural driving pressure may decrease to a point where the natural pressure is insufficient to drive the hydrocarbons to the surface given the natural permeability and fluid conductivity of the formation. At this point, the reservoir permeability and/or pressure must be enhanced by external means. In secondary recovery, treatment fluids are injected into the reservoir to supplement the natural permeability. Such treatment fluids may include water, natural gas, air, carbon dioxide or other gas and a proppant to hold the fractures open.

Likewise, in addition to enhancing the natural permeability of the reservoir, it is also common through tertiary recovery, to increase the mobility of the hydrocarbons themselves in order to enhance extraction, again through the use of treatment fluids. Such methods may include steam injection, surfactant injection and carbon dioxide flooding. In both secondary and tertiary recovery, hydraulic fracturing may also be used to enhance production.

Depending on the nature of the secondary or tertiary operation, it may be necessary to redeploy a rig, often referred to as a "workover rig," to the wellbore to assist in these operations, which may require additional equipment be installed in a wellbore. For example, subjecting a producing wellbore to hydraulic fracturing pressures after it has been producing may damage certain casings, installations, or equipment already in a wellbore. Thus, it may be necessary to install additional equipment to protect the various equipment and tools already in the wellbore before proceeding with such operations. Such additional equipment is typically of sufficient size and weight that requires the use of a workover rig. As the number of secondary wellbores in a multilateral wellbore increases, the difficulty in protecting the various equipment in the first wellbore and the secondary wellbores becomes even more pronounced.

It would be desirable to provide a system that avoids the need for drilling or workover rigs in treatment fluid operations in multilateral wellbores, particularly those subject to stimulation techniques such as hydraulic fracturing.

BRIEF DESCRIPTION

Reference is now made to the following descriptions taken in conjunction with the accompanying drawings, in which.

DETAILED DESCRIPTION

Figure 1:
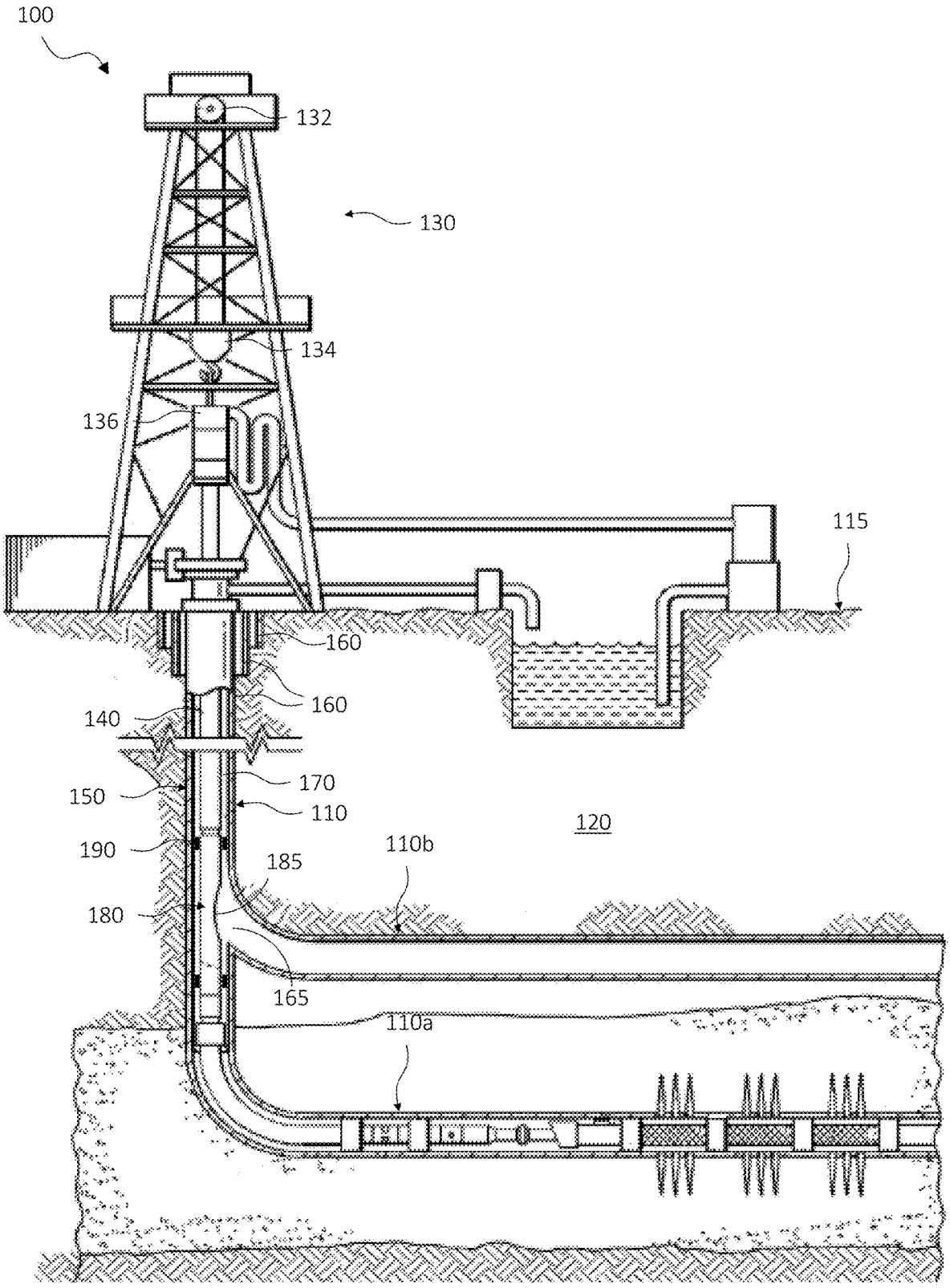
FIG. 1 illustrates a schematic view of a well system designed, manufactured and operated according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

As used herein, "first wellbore" shall mean a wellbore from which another wellbore extends (or is desired to be drilled, as the case may be). Likewise, a "second" or "secondary wellbore" shall mean a wellbore extending from another wellbore. The first wellbore may be a primary, main or parent wellbore, in which case, the secondary wellbore is a lateral or branch wellbore. In other instances, the first wellbore may be a lateral or branch wellbore, in which case the secondary wellbore is a "twig" or a "tertiary" wellbore.

Generally, in one or more embodiments, an isolation system (e.g., as might be used to complete a main wellbore or lateral wellbore, fracture a main wellbore or lateral wellbore, drill a main wellbore or lateral wellbore, workover a main wellbore or lateral wellbore, etc.) is provided in a multilateral wellbore with a secondary wellbore extending from a first wellbore. The isolation system includes a tubular having an opening therein that aligns with a secondary wellbore window formed in the casing string of the first wellbore. The isolation system may include annular seals along the outer surface of the tubular above and below the opening, and may further include an orientation device carried within the tubular. In one or more embodiments, a main bore isolation sleeve is positioned within the isolation system to seal the opening in the isolation system and the secondary wellbore window in the first wellbore casing to isolate the secondary wellbore from high pressure fluid directed farther down the first wellbore casing. In one or more embodiments, a whipstock seats on the orientation device so that a surface of the whipstock is aligned with the secondary wellbore window of the first wellbore casing string. In one or more embodiments, a straddle stimulation tool abuts the surface of the whipstock and extends through the isolation system opening from the first wellbore into the secondary wellbore.

Turning to FIG. 1, illustrated is a schematic view of a well system 100 designed, manufactured and/or operated according to one or more embodiments of the disclosure. The well system 100, in the illustrated embodiment, includes a wellbore 110 extending below the earth's surface 115 through one or more subterranean formations 120 (e.g., subterranean petroleum formations). The wellbore 110 may be formed of a single first wellbore and may include one or more second or secondary wellbores 110*a*, 110*b* . . . 110*n*, extending into the subterranean formation 120, and disposed in any orientation and spacing, such as the horizontal secondary wellbores 110*a*, 110*b* illustrated.

The well system 100 illustrated in FIG. 1 may additionally include a drilling rig or derrick 130. The drilling rig or derrick 130 may include a hoisting apparatus 132, a travel block 134, and a swivel 136 for raising and lowering a conveyance 140 within the wellbore 110. The conveyance 140 may comprise many different tubulars and remain within the scope of the disclosure. In at least one embodiment, the conveyance 140 is casing, drill pipe, coiled tubing, production tubing, and other types of pipe or tubing strings. In yet another embodiment, the conveyance 140 is wireline, slickline, or the like. In FIG. 1, however, the conveyance 140 is a substantially tubular, axially extending work string formed of a plurality of drill pipe joints coupled together end-to-end.

The well system 100 illustrated in FIG. 1 may generally be characterized as having a pipe system 150. For purposes of this disclosure, the pipe system 150 may include casing, risers, tubing, drill strings, completion or production strings, subs, heads or any other pipes, tubes or equipment that attaches to the foregoing, as well as the wellbore and laterals in which the pipes, casing and strings may be deployed. In this regard, pipe system 150 may include one or more casing strings 160 that may be cemented in wellbore 110, such as the surface, intermediate and production casing strings 160 shown in FIG. 1. An annulus 170 is formed between the walls of sets of adjacent tubular components, such as concentric casing strings 160 or the exterior of conveyance 140 and the inside wall of wellbore 110 or casing strings 160, as the case may be.

The well system 100 illustrated in FIG. 1 additionally includes an isolation system 180. In the illustrated embodiment, the isolation system 180 is positioned adjacent the secondary wellbore 110*b* so that an opening 185 in the isolation system 180 is aligned with a casing window 165 of casing string 160 adjacent secondary wellbore 110*b*. In at least one embodiment, the isolation system 180 employs one or more annular seals between two or more of its concentric tubulars. For example, in at least one embodiment, the isolation system 180 employs one or more annular seals 190 along the outer surface of the tubular above and below the opening 185. In yet other embodiments, the one or more annular seals 190 of the isolation system 180 are positioned within the first wellbore 110, or alternative positioned within the second or secondary wellbores 110*a*, 110*b*.

In accordance with one embodiment of the disclosure, the one or more annular seals 190 in the well system 100 (e.g., in the isolation system 180) are I-shaped seals. The term I-shaped seal, as used herein, means that the annular seal includes a pair of opposing members separated by a central member (e.g., central rigid member), the central member defining first and second fluid cavities on opposing sides thereof. In certain embodiments, the I-shaped seal may also be referred to as H-shaped seals, for example depending on their orientation. Accordingly, the term I-shaped seal and H-shaped seal are synonymous.

Figure 2:
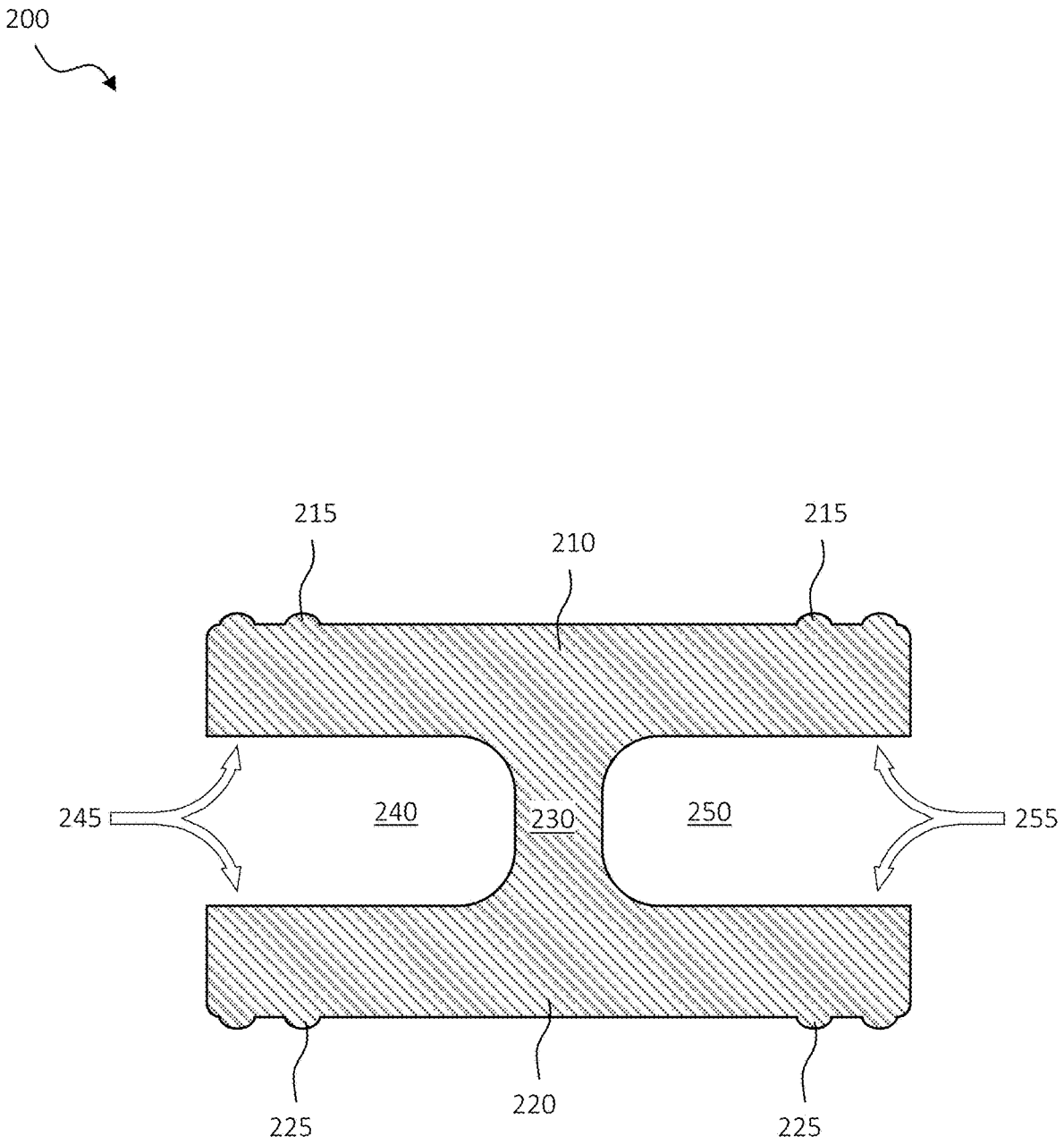
FIG. 2 illustrates one embodiment of an I-shaped seal designed, manufactured and employed according to one or more embodiments of the disclosure, as might have been used in the well system of FIG. 1.

Turning to FIG. 2, illustrated is. The I-shaped seal 200 illustrated in FIG. 2 includes first and second opposing members 210, 220, which are separated by a central member 230. Accordingly, in at least the embodiment of FIG. 2, the central member 230 defines a first fluid cavity 240 and a second fluid cavity 250. In one or more embodiments, the first fluid cavity 240 might be coupled to a first fluid pressure 245, whereas the second fluid cavity 250 might be coupled to a second fluid pressure 255. Depending on the locations of the I-shaped seal 200, the first fluid pressure 245 might be a tubing pressure, and the second fluid pressure 255 might be an annulus pressure, or vice versa, among other configurations.

In one or more embodiments, the I-shaped seal 200 may additionally include one or more engagement features 215, 225 along a radially exterior surface of the first member 210 and a radially interior surface of the second member 220, respectively. The one or more engagement features 215, 225, at least in one embodiment, may be pushed radially outward and radially inward, respectively, as the first fluid pressure 245 engages with the first fluid chamber 240 and the second fluid pressure 255 engages with the second fluid chamber 250. Accordingly, the one or more engagement features 215, 225 may be employed to provide increased sealing.

In at least one embodiment, the I-shaped seal 200 is a metal I-shaped seal. For example, the metal I-shaped seal could be a steel I-shaped seal. In yet other embodiments, the I-shaped seal might include one or more of the following metals or alloys: 316 Stainless, C-276 alloy, 718 alloy, tungsten carbide, cemented carbide, brass, and/or bronze, etc., among other metals and/or alloys and/or composites. Thus, when placed between two metal tubulars, such as that shown in FIG. 1, the I-shaped seal 200 may provide a metal-to-metal seal therebetween.

Figure 3:
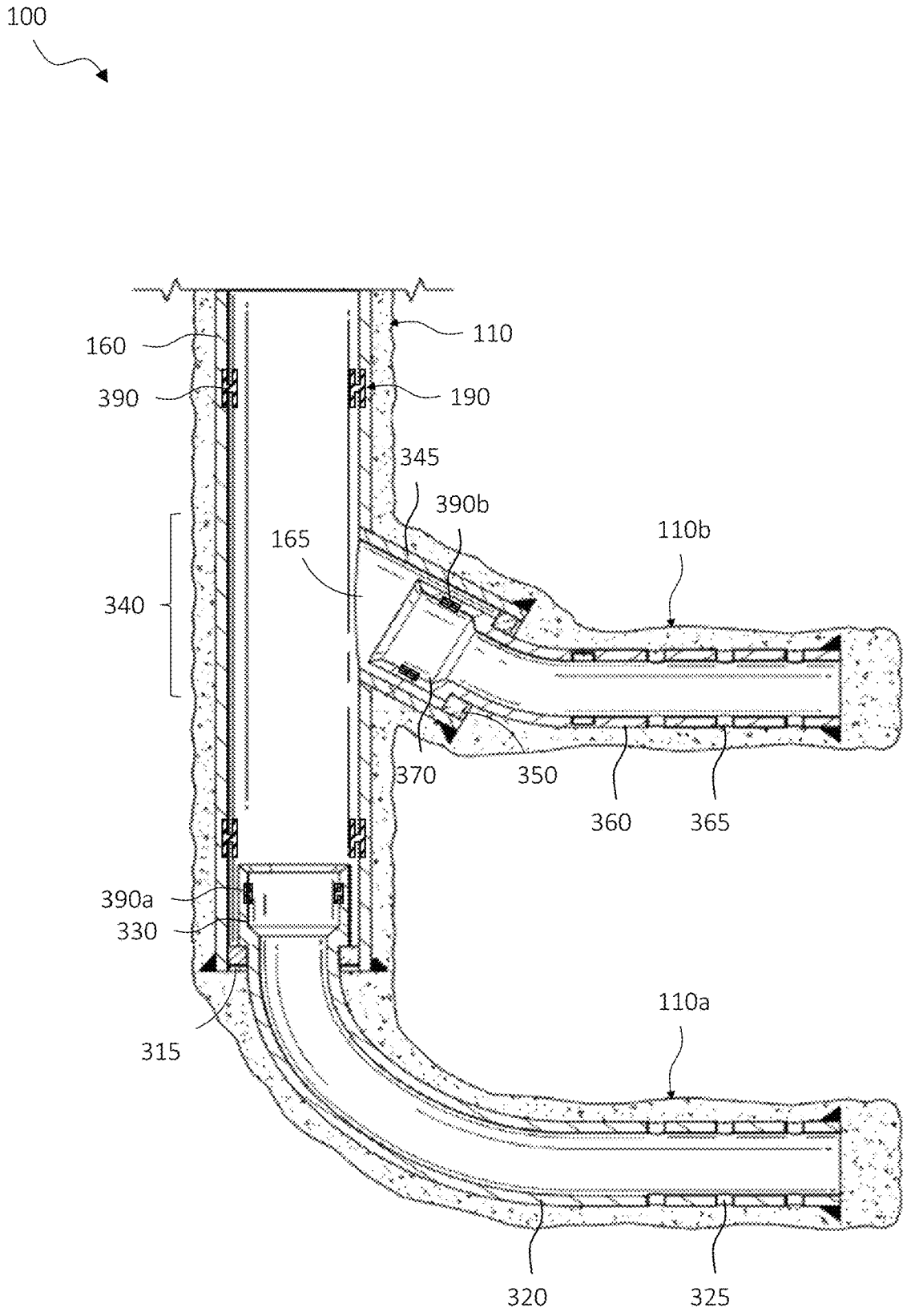
FIG. 3 illustrates a detailed elevation view in cross-section of the first wellbore, and the upper and lower secondary wellbores, respectively, illustrated as extending from first wellbore, as shown in FIG. 1.

Turning to FIG. 3, illustrated is a detailed elevation view in cross-section of the first wellbore 110, and the upper and lower secondary wellbores, 110*b* and 110*a*, respectively, illustrated as extending from first wellbore 110, as shown in FIG. 1. Specifically, the first wellbore 110 is illustrated as being at least partially cased with the first wellbore casing 160 cemented therein. While generally illustrated as vertical, first wellbore 110, as well as any of the wellbores described, may have any orientation. In any event, at the distal end of first wellbore 110, a casing hanger 315 may be deployed from which a secondary wellbore casing 320 (e.g., a liner in one embodiment) hangs. Secondary wellbore casing 320 has a proximal end and a distal end. The proximal end may include a shoulder for supporting the secondary wellbore casing 320 on the hanger 315. The distal end may include perforations 325 or sliding sleeves. The secondary wellbore casing 320 is illustrated as cemented in place within the secondary wellbore 110*a*. Proximal end may also include a polished bore receptacle (PBR) 330, which may be positioned above the casing hanger 315. PBR 330 may have a larger inner diameter than the secondary wellbore casing 320.

Likewise, with regard to secondary wellbore 110*b*, which is formed at a junction 340 with first wellbore 110, a transition joint 345 may extend from the casing window 165 formed along the inner annulus of the casing 160. Transition joint 345 may be made of steel, fiberglass, or any material capable of supporting itself under the pressure of fluids, cement, or solid objects such as rock in a downhole environment. A casing hanger 350 may be deployed from which a secondary wellbore casing 360 hangs. Secondary wellbore casing 360 has a proximal end, a distal end and an interior surface. The distal end may include perforations 365 or a sliding sleeve. The proximal end may include a shoulder for supporting the secondary wellbore casing 360 on the casing hanger 350. Secondary wellbore casing 360 is illustrated as cemented in place within secondary wellbore 110*b*. In other embodiments (not shown) the transition joint 345 may be threaded directly to a PBR 370, which in turn is threaded to the secondary wellbore casing 360, and no casing hanger 350 is necessary.

In one or more embodiments, the well system 100 may further include the one or more I-shaped seals 190. As shown in FIG. 3, one or more I-shaped seals 390 may be located in the first wellbore 110, for example embedded at least partially withing the wellbore casing 160 on opposing sides of (e.g., straddling) the casing window 165. In yet another embodiment, whether alone or in combination with the I-shaped seals 390, I-shaped seals 390*a* may be positioned along the interior surface of the PBR 330. In yet another embodiment, whether alone or in combination with the I-shaped seals 390, 390*a*, I-shaped seals 390*b* may be positioned along the interior surface of the PBR 370. The I-shaped seals 390, 390*a*, 390*b*, in certain embodiments, may be similar to the I-shaped seal 200 illustrated in FIG. 2.

In at least one embodiment, one or more of the I-shaped seals 190 are located near the junction 340. The term "near", as that term is used with regard to the placement of the one or more I-shaped seals 190 relative to the junction 340, means that the one or more I-shaped seals 190 are located less than 100 meters from the junction 340. In at least one other embodiment, one or more of the I-shaped seals 190 are located in close proximity with the junction 340. The term "in close proximity", as that term is used with regard to the placement of the one or more I-shaped seals 190 relative to the junction 340, means that the one or more I-shaped seals 190 are located less than 5 meters from the junction 340. In at least one other embodiment, one or more of the I-shaped seals 190 are located proximate the junction 340. The term "proximate", as that term is used with regard to the placement of the one or more I-shaped seals 190 relative to the junction 340, means that the one or more I-shaped seals 190 are located less than 1 meter from the junction 340.

Figure 4:
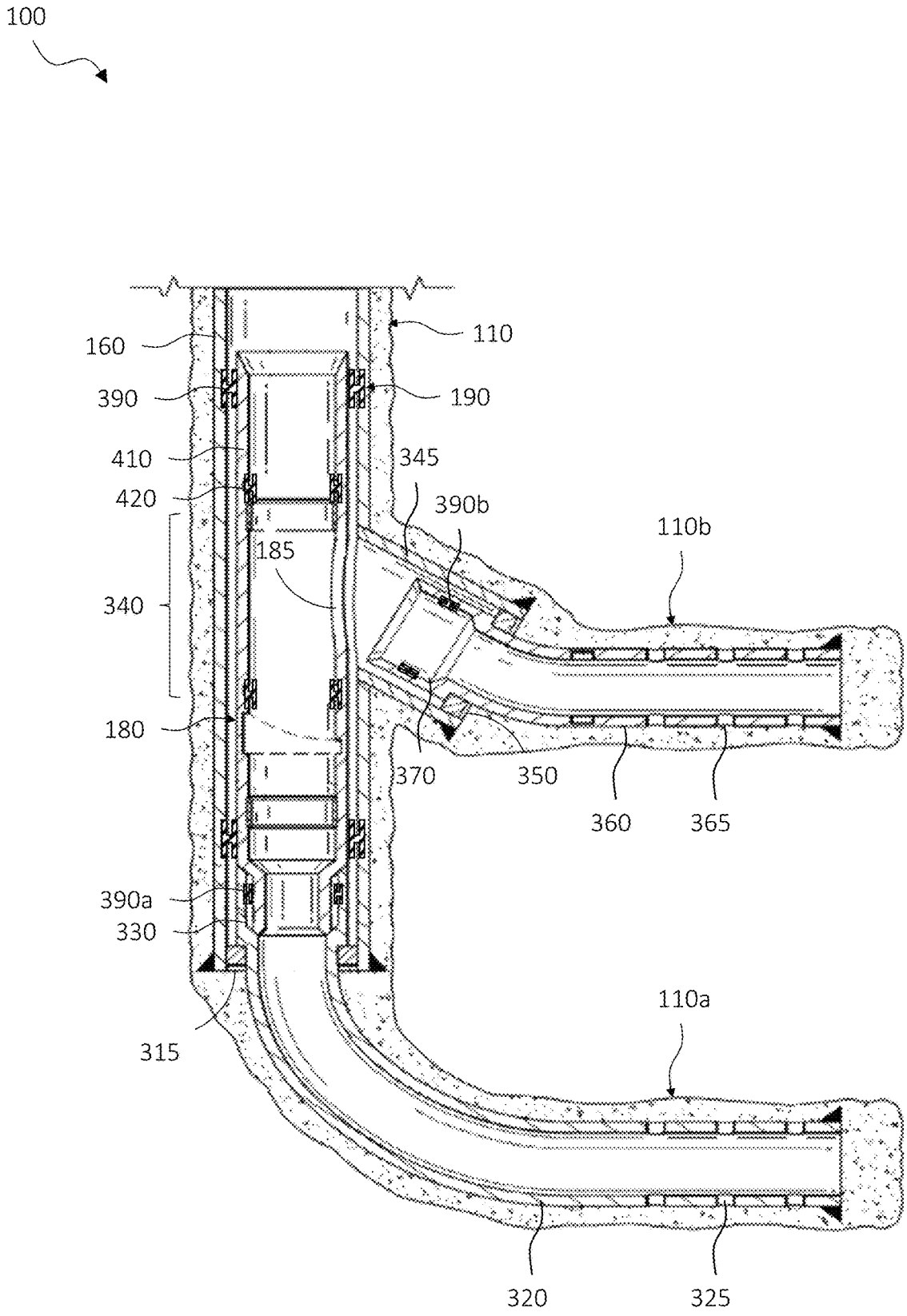
FIG. 4 illustrates a detailed elevation view in cross-section of the well system of FIG. 3 after deploying the isolation system adjacent the junction within the first wellbore casing.

Turning to FIG. 4, illustrated is a detailed elevation view in cross-section of the well system 100 of FIG. 3 after deploying the isolation system 180 adjacent the junction 340 within the first wellbore casing 160. The isolation system 180, in at least one embodiment, is formed of an elongated tubular 410 having a first end and a second end, with the opening 185 defined in a wall of the elongated tubular 410 between its ends. The elongated tubular 410 may extend a significant distance, and may be constructed of multiple casing, tubing, or other pipe without departing from the scope and spirit of the disclosure. The elongated tubular 410 includes an inner surface and an outer surface. In the illustrated embodiment, the I-shaped seals 390 are positioned in an annulus between the wellbore casing 160 and the outer surface of the isolation system 180.

In one or more embodiments, the well system 100 additionally includes a pair of I-shaped seals 420 disposed along an inner surface of the isolation system 180. In at least one embodiment, the pair of I-shaped seals 420 are spaced apart to seal above and below the opening 185 when another tubular is positioned therein. The I-shaped seals 420 may be similar in one or more respects to the I-shaped seals 200 described with regard to FIG. 2.

Figure 5:
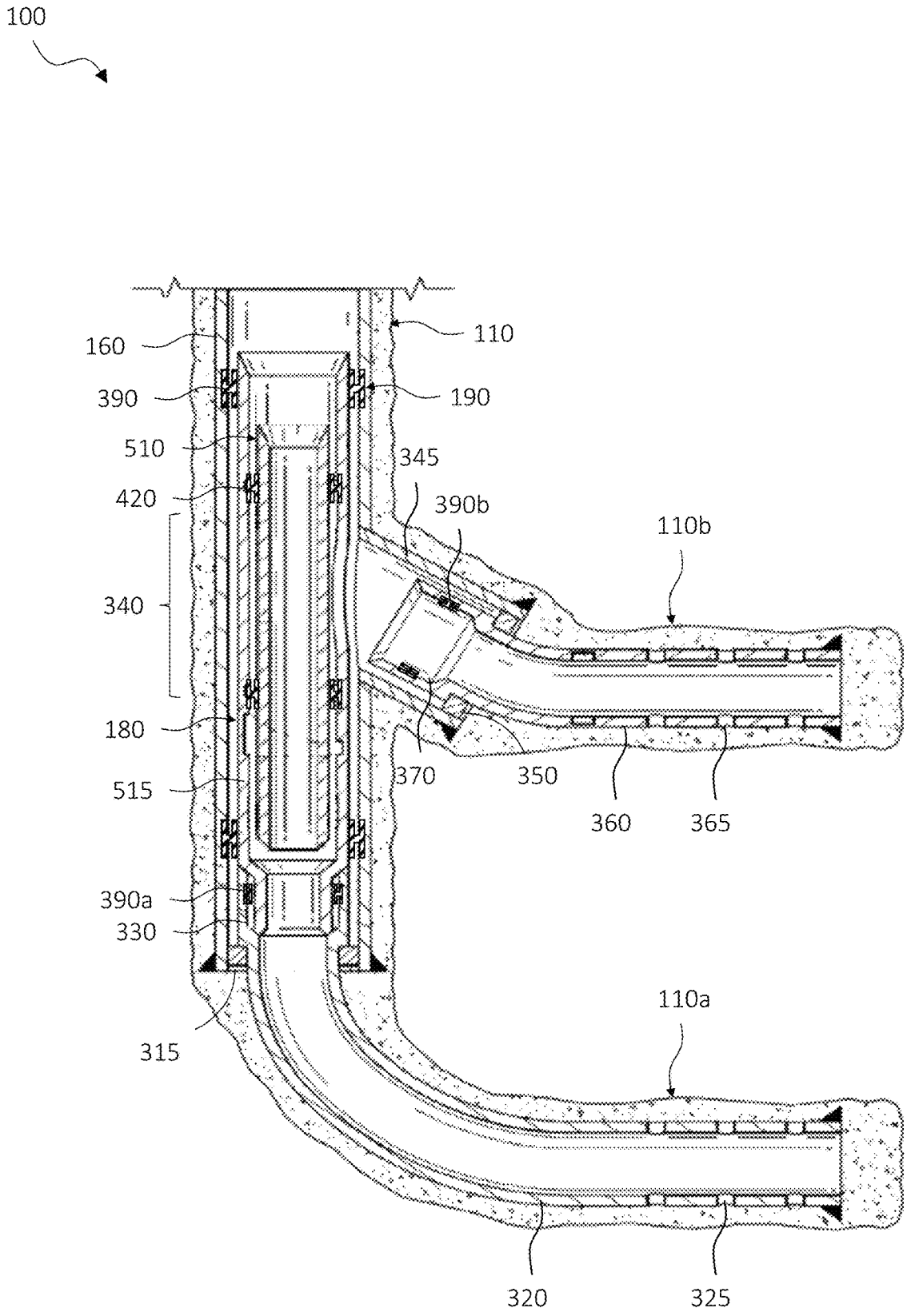
FIG. 5 illustrates a detailed elevation view in cross-section of the well system of FIG. 4 after deploying a main bore isolation sleeve therein.

Turning to FIG. 5, illustrated is a detailed elevation view in cross-section of the well system 100 of FIG. 4 after deploying a main bore isolation sleeve 510 therein. The main bore isolation sleeve 510, in one or more embodiments, is formed of a tubular sleeve 515 having a first end and a second end. Tubular sleeve 515 has an inner surface and an outer surface.

The pair of I-shaped seals 420 are spaced apart, as described above, to seal above and below the opening 185 defined in the wall of the elongated tubular 410 when the main bore isolation sleeve 510 is deployed within isolation system 180. Accordingly, when the pair of I-shaped seals 420 are properly placed, the first wellbore 110 is isolated from the secondary wellbore 110*b*. In other words, fluid communication between the first wellbore 110 and the secondary wellbore 110*b* is blocked by main bore isolation sleeve 510, allowing various operations, such as high-pressure pumping, in the first wellbore 110 or secondary wellbore 110*a* to occur without impacting secondary wellbore 110*b*. In those embodiments wherein access, whether physical or fluid access, to the secondary wellbore 110*b* is desired, the main bore isolation sleeve 510 may be removed entirely from the main wellbore 110, or alternatively slid to a location where the pair of I-shaped seals 420 are not straddling the opening 185.

Figure 6:
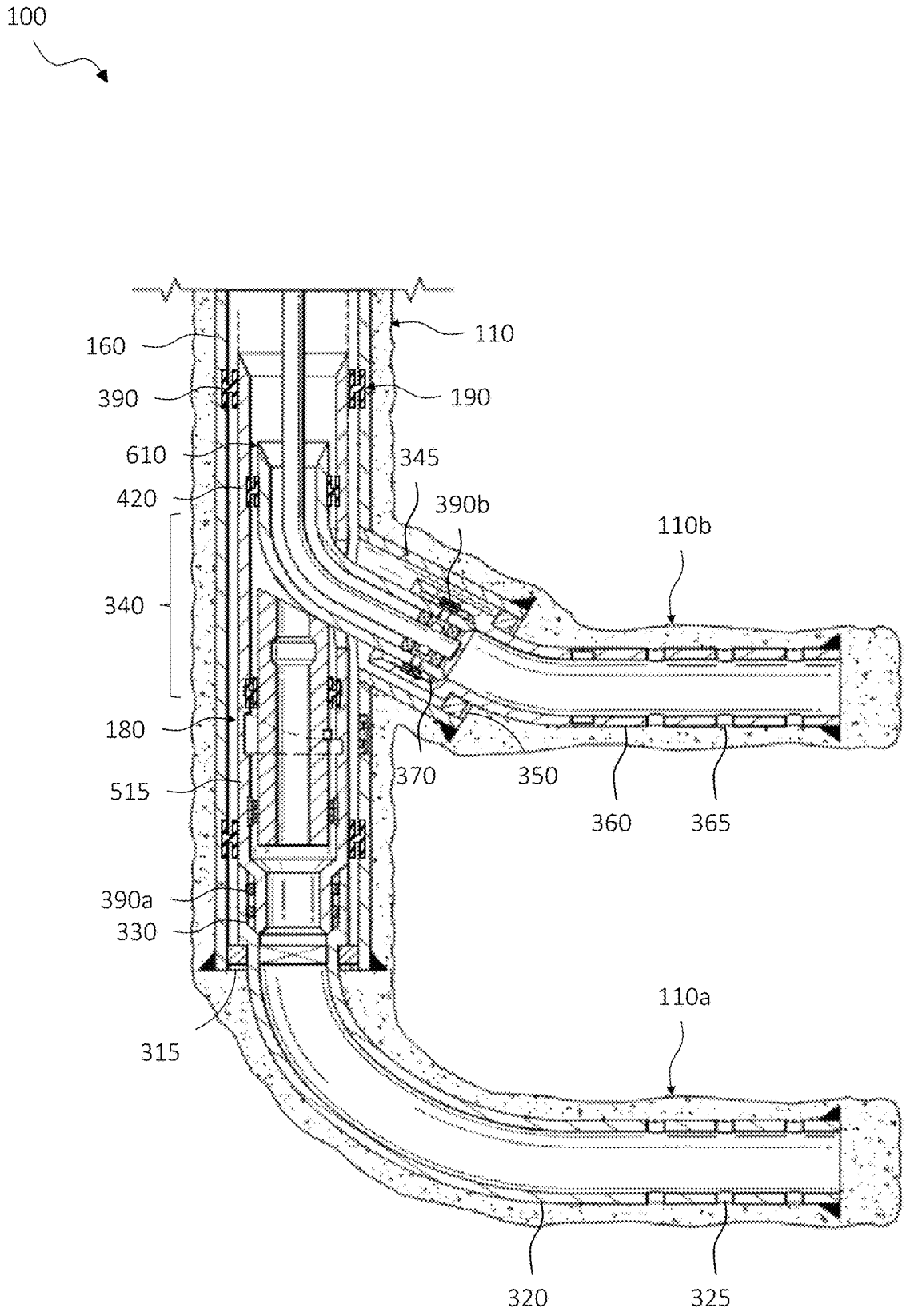
FIG. 6 illustrates a detailed elevation view in cross-section of the well system of FIG. 5 after deploying a straddle stimulation tool extending from the isolation system into the upper secondary wellbore.

Turning to FIG. 6, illustrated is a detailed elevation view in cross-section of the well system 100 of FIG. 5 after deploying a straddle stimulation tool 610 extending from the isolation system 180 into the upper secondary wellbore 110*b*. The straddle stimulation tool 610, in one or more embodiments, generally includes a straddle tubular having a first end and a second end forming a flow bore therebetween. The straddle tubular includes an inner surface and an outer surface. When deployed, the straddle stimulation tool 610 is positioned so that first end is in first wellbore 110 and the second end is in the secondary wellbore 110*b*. In this regard, the first end may be positioned within the elongated tubular 410 of the isolation system 180 and second ends may be positioned within the first end of the secondary wellbore casing 360. Accordingly, the I-shaped seals 420 may seal an annulus between the upper end of the elongated tubular 410 and the isolation system 180, whereas the I-shaped seals 390*b* may seal an annulus between the lower end of the elongated tubular and the secondary wellbore casing 360 (e.g., the PBR 370).

Figure 7A:
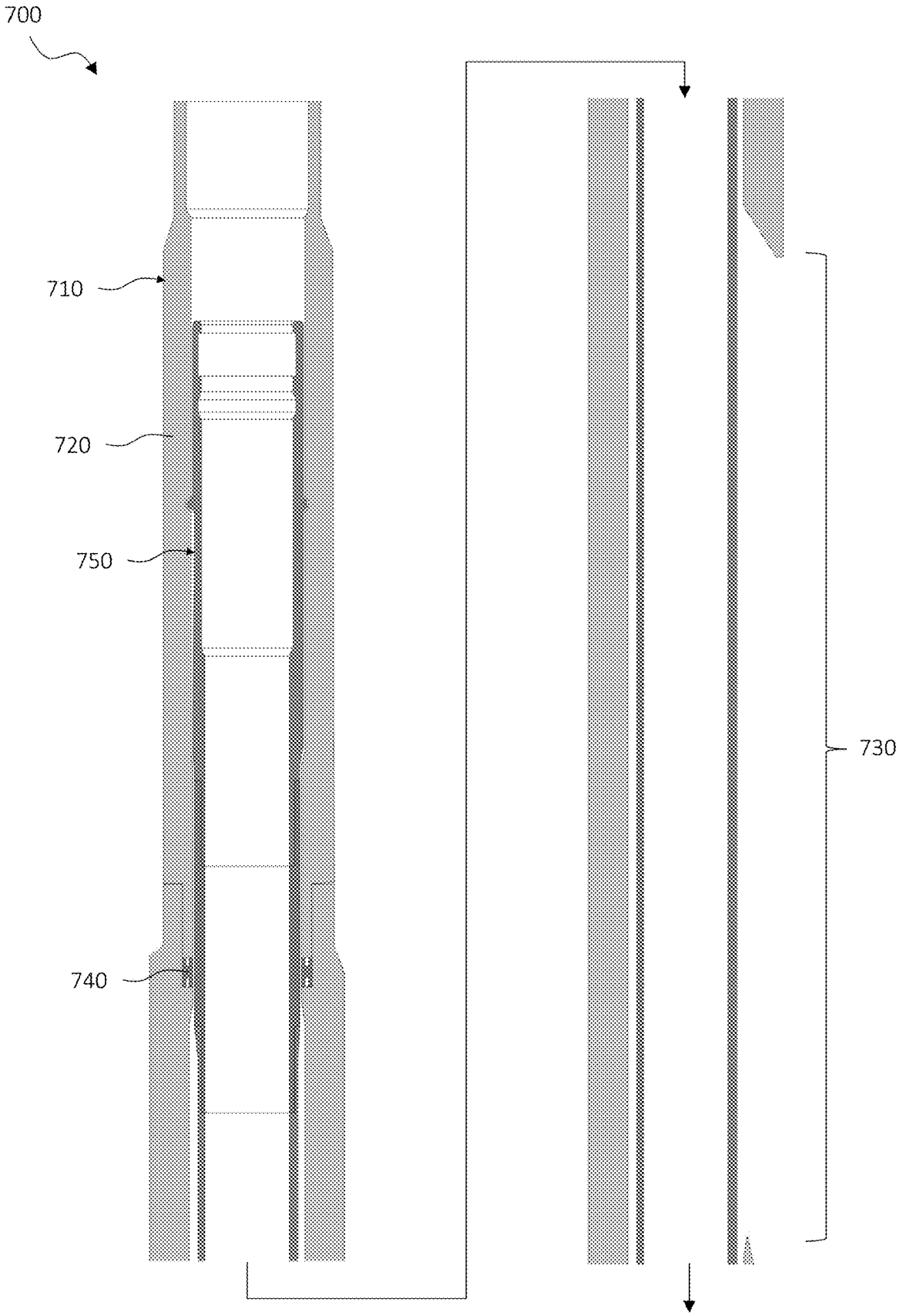
FIGS. 7A through 7C illustrate one embodiment of a downhole tool designed, manufactured and/or operated according to one or more embodiments of the disclosure.
Figure 7B:
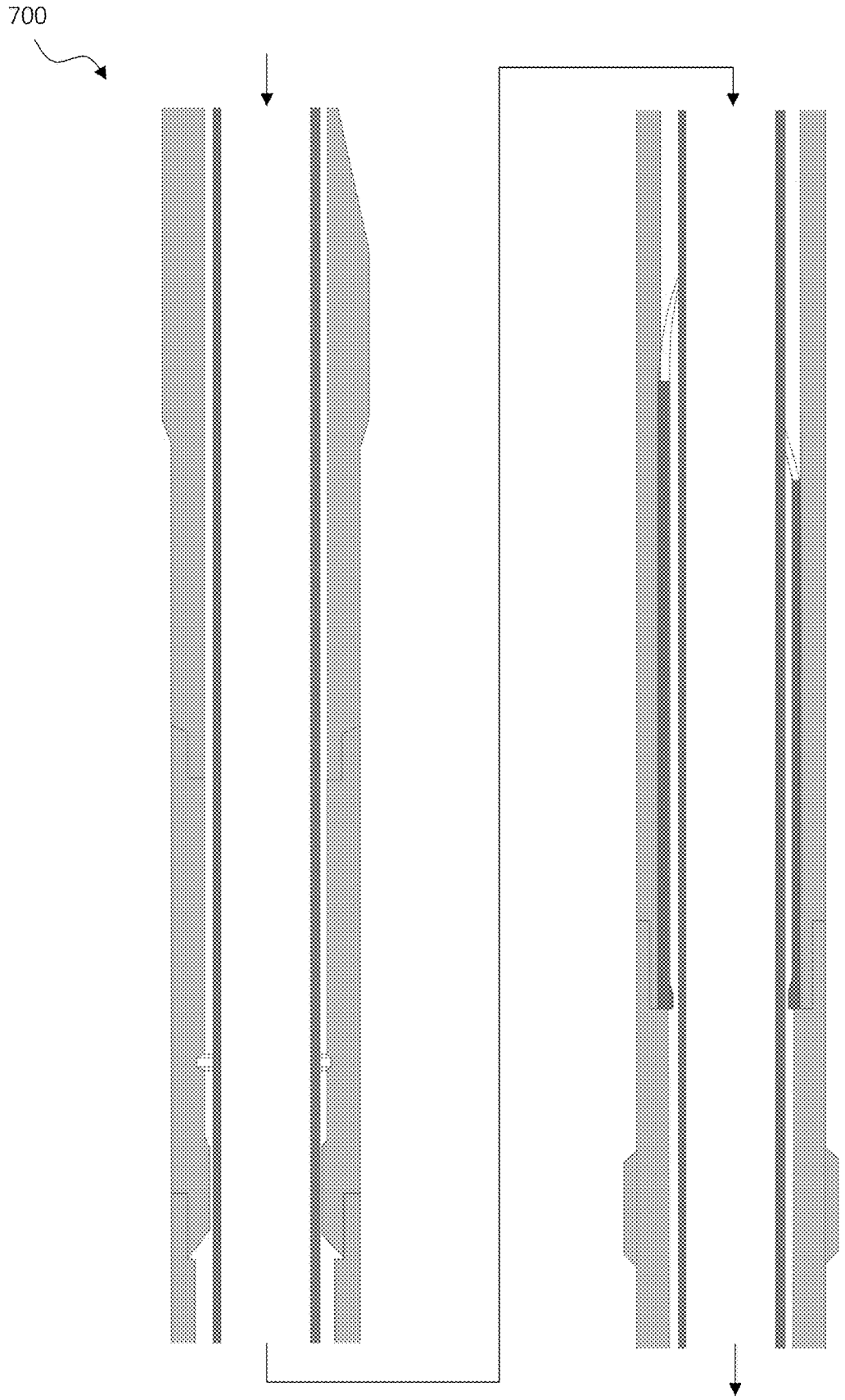
Figure 7C:
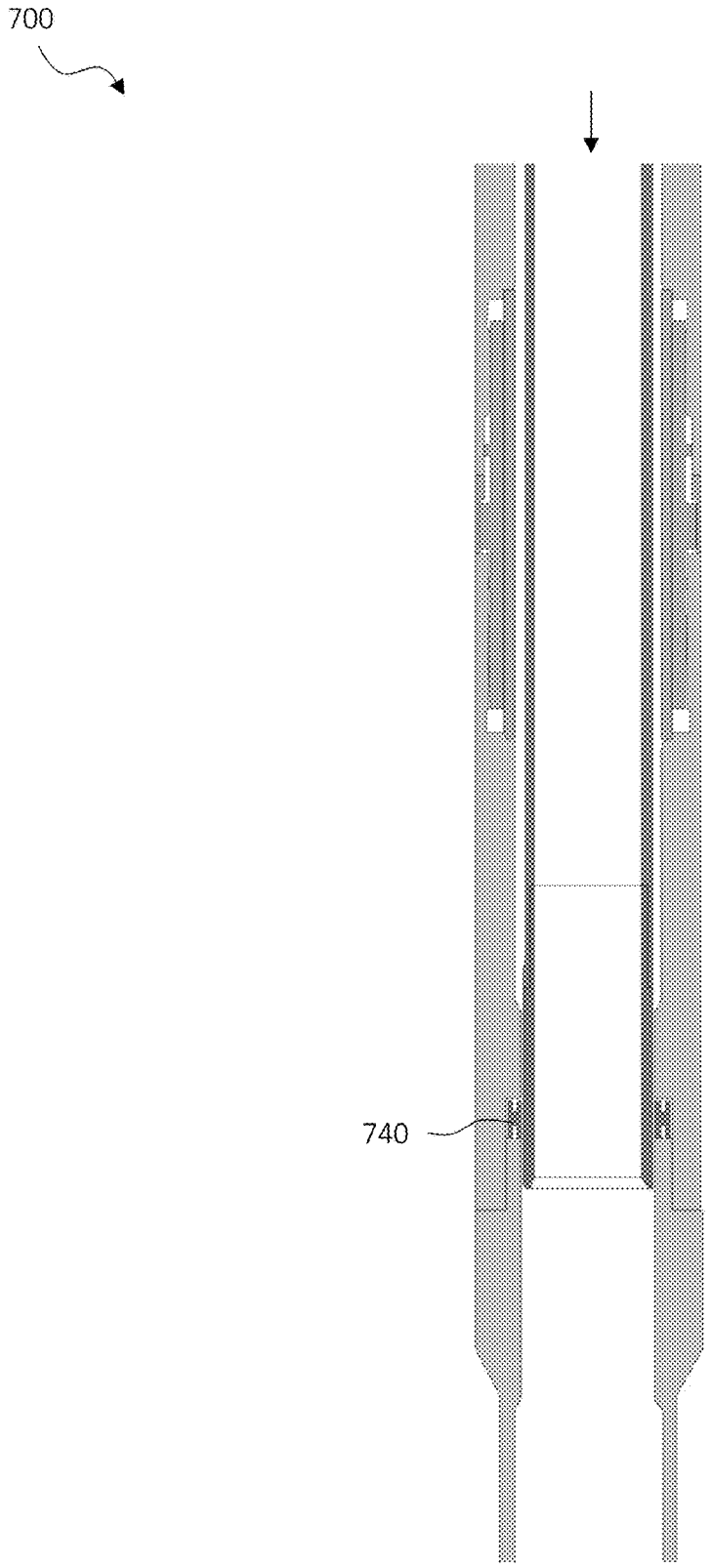

Turning now to FIGS. 7A through 7C, illustrated is one embodiment of a downhole tool 700 designed, manufactured and/or operated according to one or more embodiments of the disclosure. The downhole tool 700 of FIGS. 7A through 7C includes an isolation system 710. The isolation system 710, in the illustrated embodiment, includes an elongated tubular 720 having an opening 730 defined in a wall thereof. The opening 730, as understood from above, could be positioned at an intersection between a first wellbore and a secondary wellbore. Furthermore, in accordance with one or more embodiments of the disclosure, the isolation system 710 includes a pair of I-shaped seals 740 on opposing sides of the opening 730. The pair of I-shaped seals 740, as is illustrated, may be similar to one or more of the I-shaped seals discussed above, and particularly similar to the I-shaped seal 200 of FIG. 2.

The downhole tool 700 of FIGS. 7A through 7C may additionally include a main bore isolation sleeve 750 positioned within the isolation system 710. In the illustrated embodiment, the main bore isolation sleeve 750 extends entirely between (e.g., and a distance beyond on either side thereof) the pair of I-shaped seals 740. Accordingly, at least in the embodiment of FIGS. 7A through 7C, the opening 730 is fully isolated from fluid travelling within the isolation system 710. If access, whether it be physical access or fluid access, were desired through the opening 730, the main bore isolation sleeve 750 could be removed.

In the illustrated embodiment of FIGS. 7A through 7C, the main bore isolation sleeve 750 is configured to slide within the isolation system 710 from an uphole end of the isolation system 710. For example, when it is desired to isolate the opening 730, the main bore isolation sleeve 750 could be inserted within the isolation system 710 from a surface of the first wellbore 110. Additionally, when it is desired to provide access to the opening 730, the main bore isolation sleeve 750 could be withdrawn from the isolation system 710 and entirely uphole to the surface of the first wellbore 110. Accordingly, the main bore isolation sleeve 750 is not a permanent fixture within the well system, but is added or removed from the well system as needed.

Turning now to FIGS. 8A through 8I, illustrated is an alternative embodiment of a downhole tool 800 designed, manufactured and/or operated according to one or more embodiments of the disclosure. The downhole tool 800 is similar in many respects to the downhole tool 700 of FIGS. 7A through 7C. Accordingly, like reference numbers have been used to illustrate similar, if not identical, features. The downhole tool 800 differs, for the most part, from the downhole tool 700, in that the main bore isolation sleeve 850 of the downhole tool 800 is not configured to be removed entirely uphole when accessing and/or closing the opening 730. For example, in the embodiment of FIG. 8, the main bore isolation sleeve 850 is a permanent fixture within the well system that is configured to slide within a slot 810 within the elongated tubular 720 of the isolation system 710.

In at least one or more embodiments, the slot 810 has an uphole no-go profile 820 and a downhole no-go profile 830, the uphole no-go profile 820 and the downhole no-go profile 830 preventing the main bore isolation sleeve 850 from being removed (e.g., easily removed) and withdrawn uphole from the isolation system 710. Moreover, the uphole no-go profile 820 and the downhole no-go profile 830 may act as alignment features, such that when the main bore isolation sleeve 850 abuts the uphole no-go profile 820 it is known that the opening 730 is fully isolated, and that when the main bore isolation sleeve 850 abuts the downhole no-go profile 830 it is known that the opening 730 is fully accessible. This configuration assumes that the main bore isolation sleeve 850 is configured to slide uphole to fully isolate the opening 730. Nevertheless, the configuration could be reversed, such that the main bore isolation sleeve 850 is configured to slide downhole to fully isolate the opening 730.

In one or more embodiments, the elongated tubular 720 includes one or more profiles 840 that are configured to engage with a collet 855 in the main bore isolation sleeve 850. In one or more embodiments, the one or more profiles 840 and the collect 855 may act as a latching mechanism, for example to hold the main bore isolation sleeve 850 in place, as well as act as a secondary alignment feature.

Figure 8A:
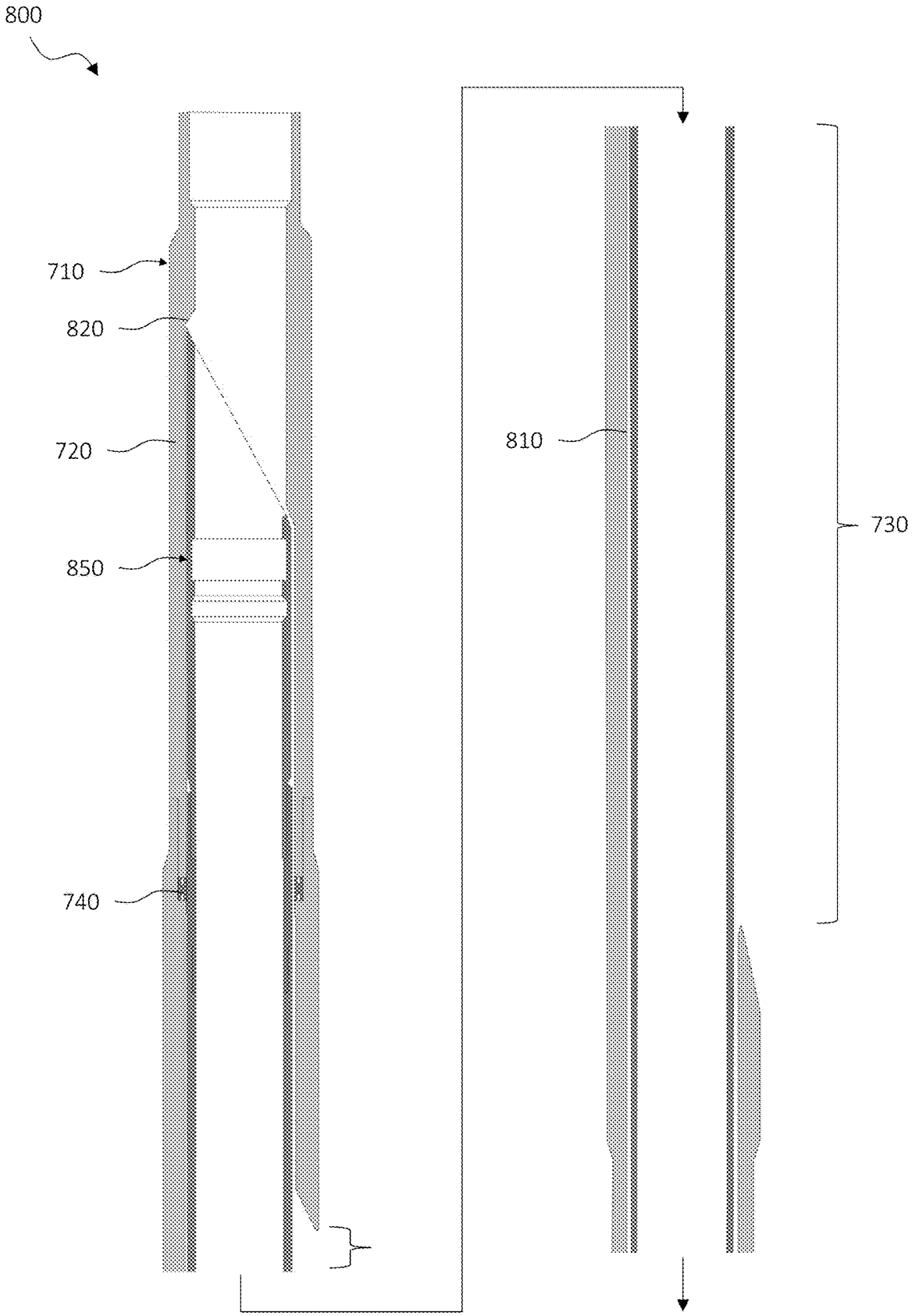
FIGS. 8A through 8I illustrate an alternative embodiment of a downhole tool designed, manufactured and/or operated according to one or more embodiments of the disclosure.
Figure 8B:
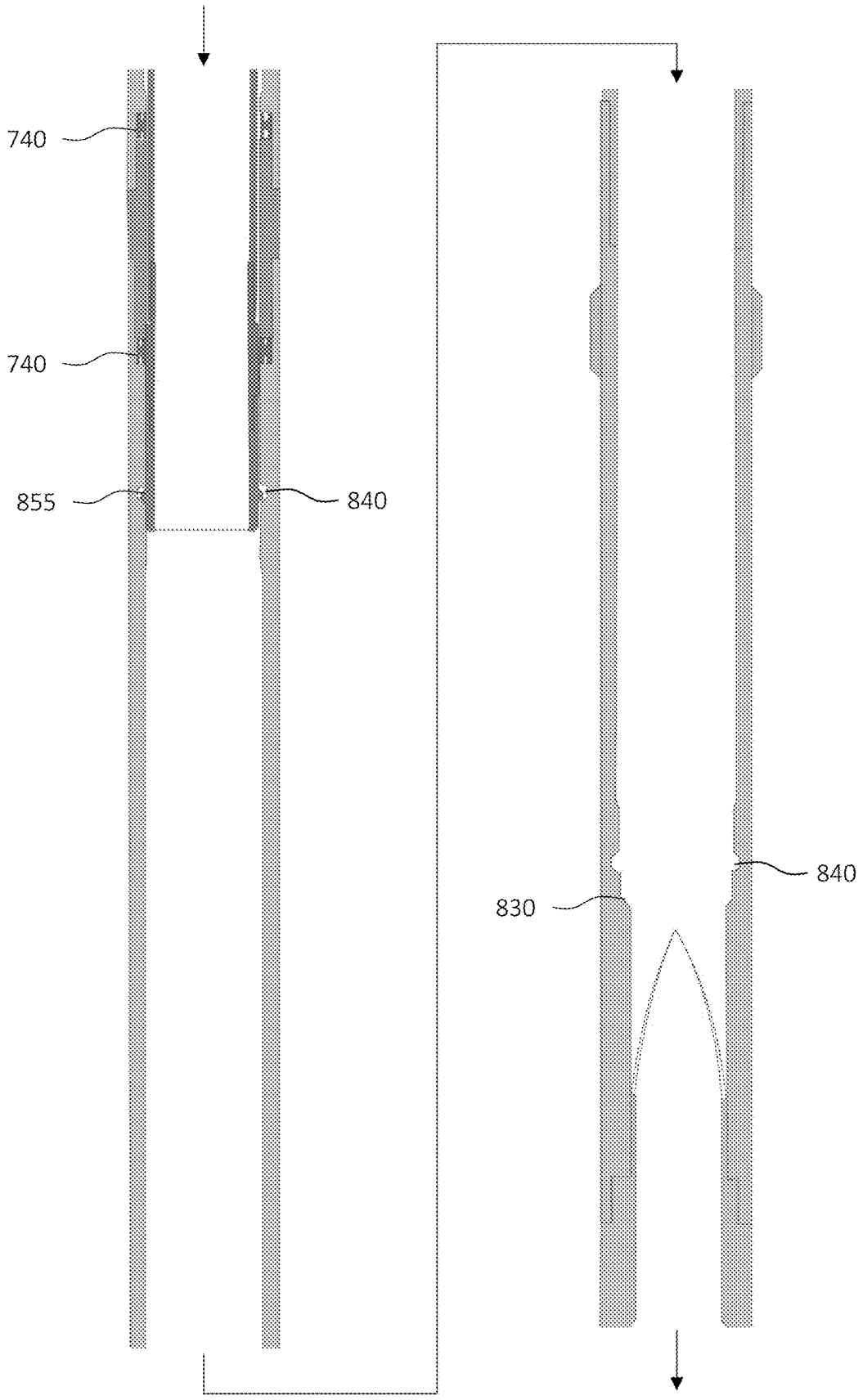
Figure 8C:
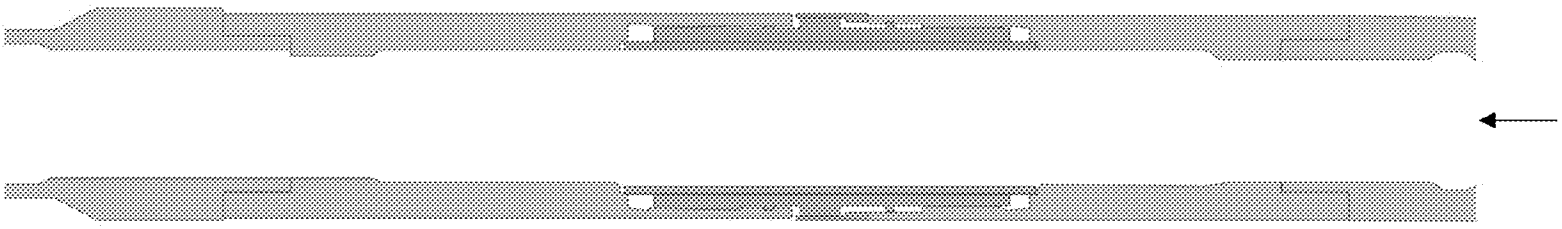
Figure 8D:
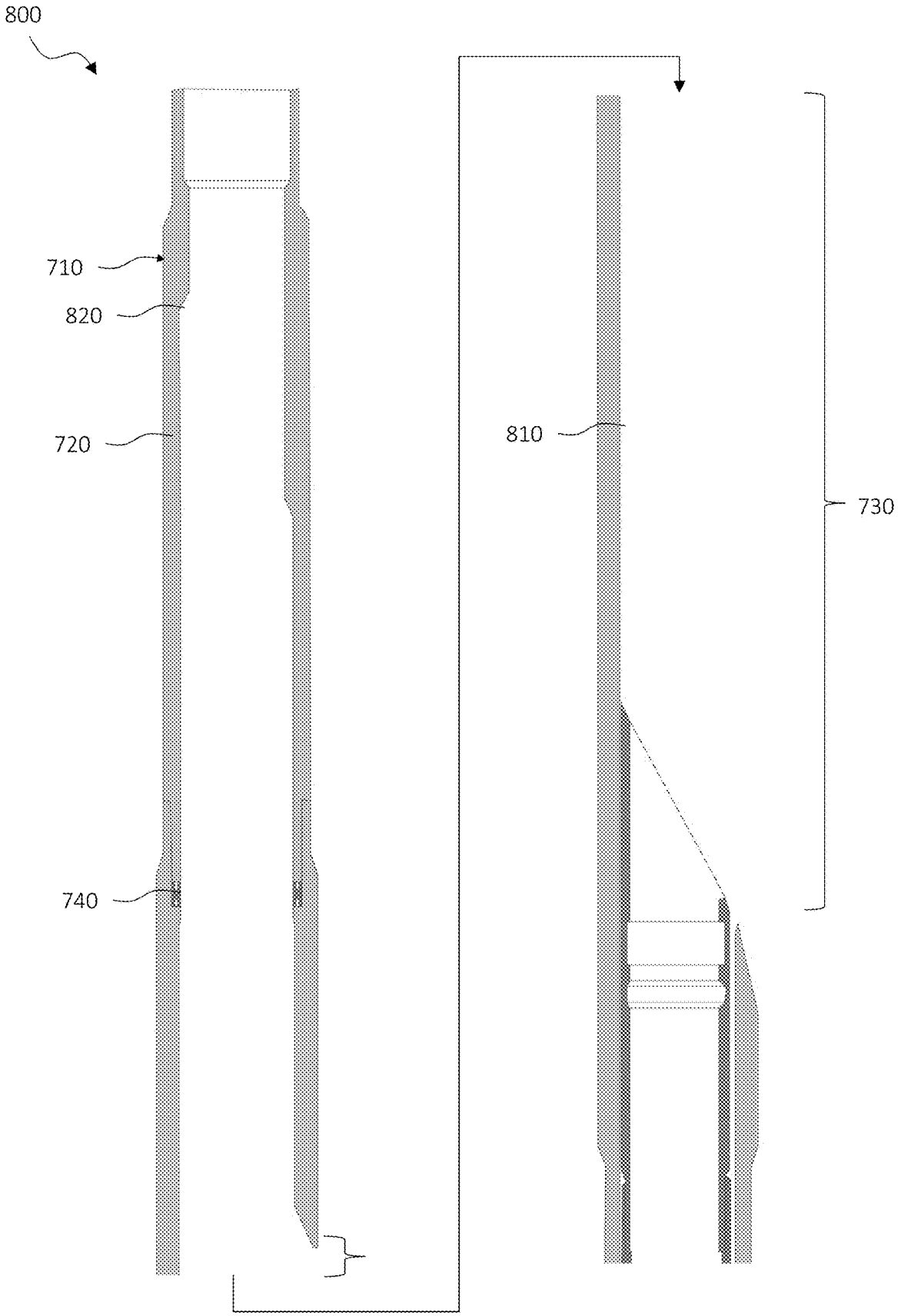
Figure 8E:
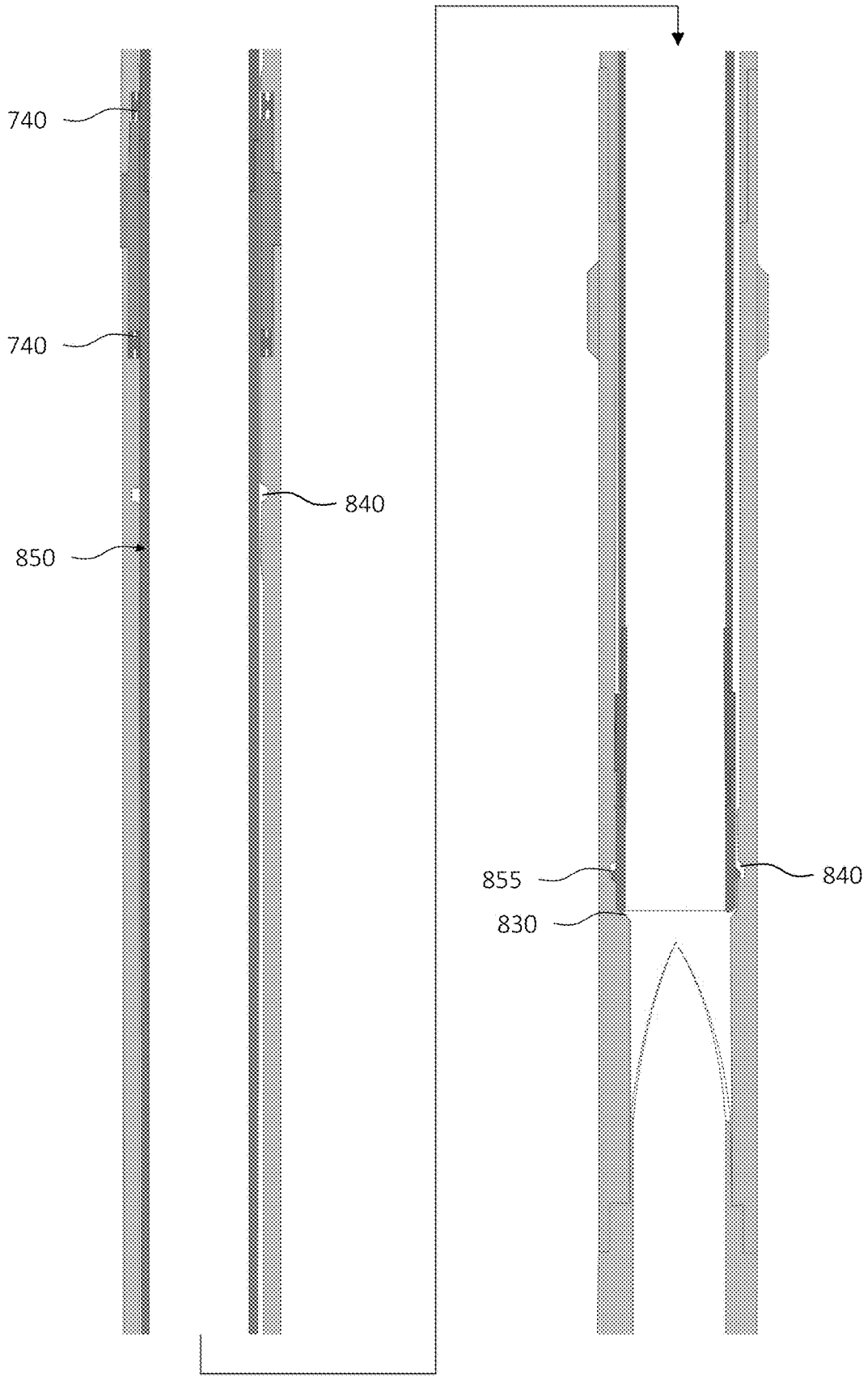
Figure 8F:
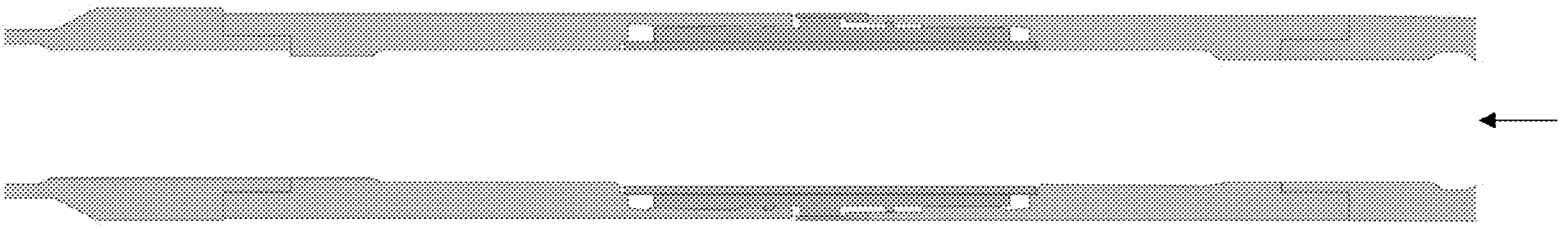
Figure 8G:
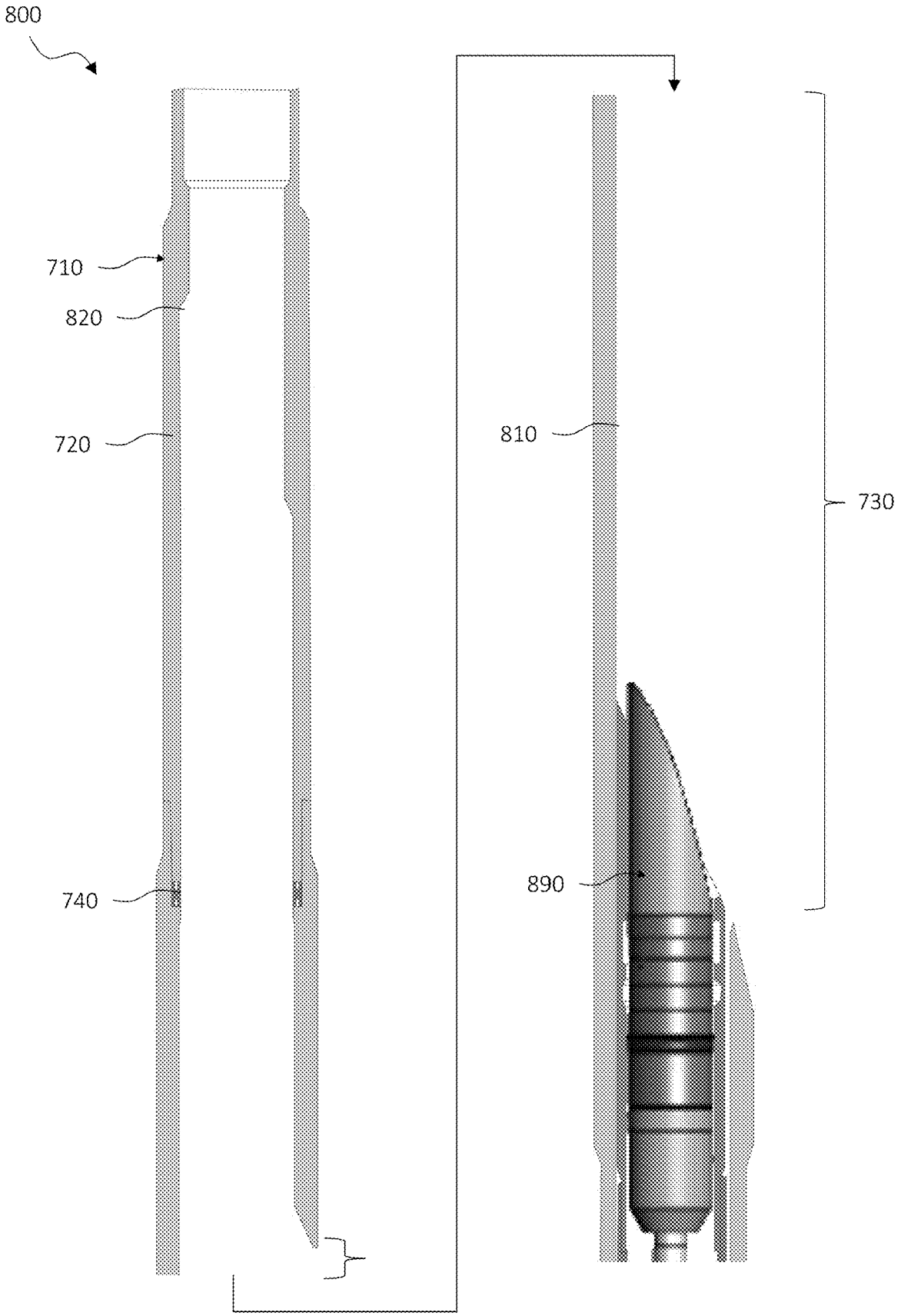
Figure 8H:
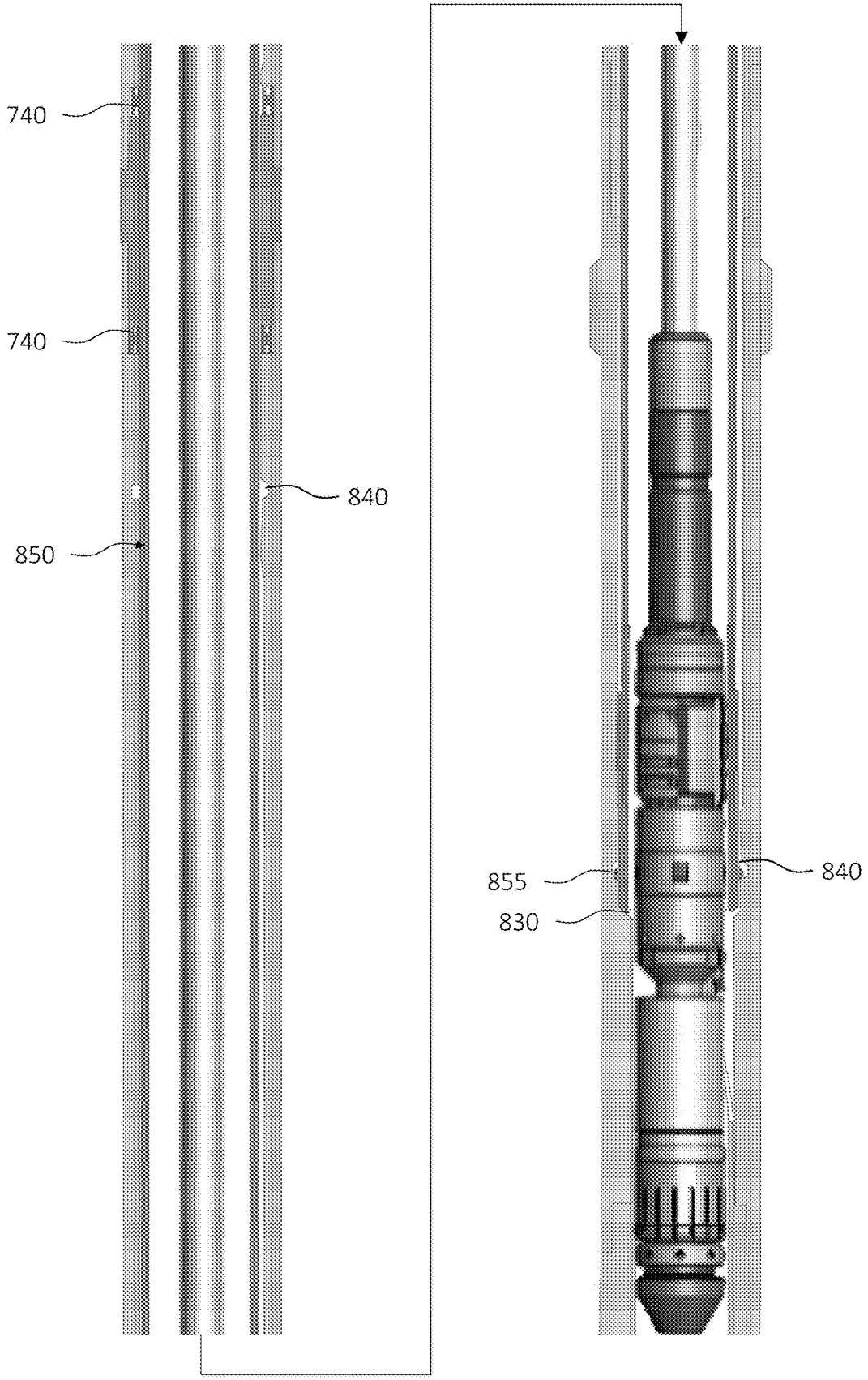
Figure 8I:
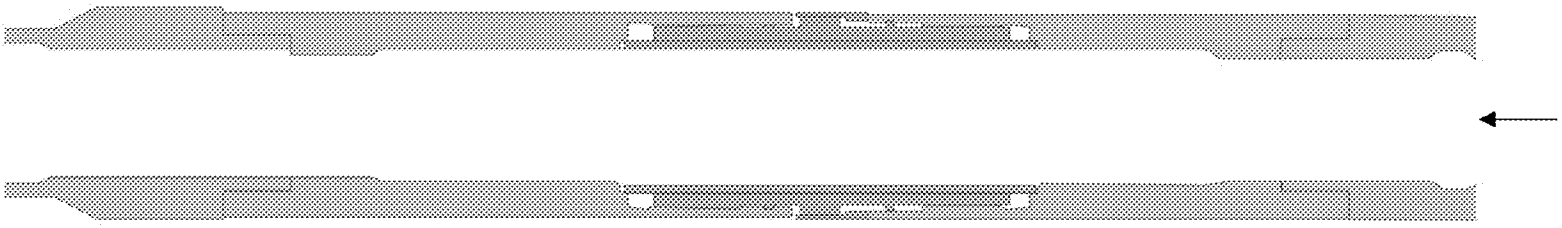

FIGS. 8A through 8C illustrate the main bore isolation sleeve 850 in the uphole position, such that it is engaged with the uphole no-go profile 820 in the elongated tubular 720, and thus fully isolating the opening 730. In contrast, FIGS. 8D through 8F illustrate the main bore isolation sleeve 850 in the downhole position, such that it is engaged with the downhole no-go profile 830 in the elongated tubular 720, and thus provide full access through the opening 730. In further contrast, FIGS. 8G through 8I illustrate a whipstock assembly 890 (e.g., tubing exit whipstock "TEW" assembly) positioned in the main bore isolation sleeve 850 proximate the opening 730. In this embodiment, the whipstock assembly 890 may be used to redirect a separate downhole tool out the opening 730 and into the secondary wellbore.

Aspects disclosed herein include:

A. A downhole tool, the downhole tool including: 1) a tubular, the tubular having an opening connecting an interior of the tubular and an exterior of the tubular; 2) first and second I-shaped seals on opposing sides of the opening, each of the first and second I-shaped seals including: a) first and second opposing members; and b) a central member separating the first and second opposing members, the central member defining first and second fluid cavities.

B. A well system, the well system including: 1) a first wellbore; 2) a secondary wellbore extending from the first wellbore; 3) wellbore casing located in the first wellbore, the wellbore casing having a casing window connecting an interior of the wellbore casing and an exterior of the wellbore casing, the casing window located at a junction between the first wellbore and the secondary wellbore; 4) first and second I-shaped seals on opposing sides of the casing window, the first and second I-shaped seals configured to isolate the first wellbore from the secondary wellbore, each of the first and second I-shaped seals including: a) first and second opposing members; and b) a central member separating the first and second opposing members, the central member defining first and second fluid cavities.

C. A well system, the well system including: 1) a first wellbore; 2) a secondary wellbore extending from the first wellbore; 3) wellbore casing located in the first wellbore, the wellbore casing having a casing window connecting an interior of the wellbore casing and an exterior of the wellbore casing, the casing window located at a junction between the first wellbore and the secondary wellbore; and 3) one or more I-shaped seals located near the junction, the one or more I-shaped seals configured to isolate the first wellbore from the secondary wellbore, each of the one or more I-shaped seals including: a) first and second opposing members; and b) a central member separating the first and second opposing members, the central member defining first and second fluid cavities.

D. A downhole tool, the downhole tool including: 1) an isolation system for placement at a junction between a first wellbore and a secondary wellbore, the isolation system including: a) an elongated tubular, the elongated tubular having an opening connecting an interior of the elongated tubular and an exterior of the elongated tubular; b) a slot located in the elongated tubular, the slot spanning the opening; c) an isolation sleeve located within the isolation system, the isolation sleeve configured to slide within the slot to either isolate the interior of the elongated tubular from the exterior of the elongated tubular or provide access between the interior of the elongated tubular and the exterior of the elongated tubular; and d) an I-shaped seal located in an annulus between the elongated tubular and the isolation sleeve, the I-shaped seal including: i) first and second opposing members; and ii) a central member separating the first and second opposing members, the central member defining first and second fluid cavities.

E. A well system, the well system including: 1) a first wellbore; 2) a secondary wellbore extending from the first wellbore; 3) wellbore casing located in the first wellbore, the wellbore casing having a casing window connecting an interior of the wellbore casing and an exterior of the wellbore casing, the casing window located proximate a junction between the first wellbore and the secondary wellbore; and 4) a downhole tool positioned at the junction, the downhole tool including: a) an isolation system, the isolation system including: i) an elongated tubular, the elongated tubular having an opening connecting an interior of the elongated tubular and an exterior of the elongated tubular; ii) a slot located in the elongated tubular, the slot spanning the opening; iii) an isolation sleeve located within the isolation system, the isolation sleeve configured to slide within the slot to either isolate the interior of the elongated tubular from the exterior of the elongated tubular or provide access between the interior of the elongated tubular and the exterior of the elongated tubular; iv) an I-shaped seal located in an annulus between the elongated tubular and the isolation sleeve, the I-shaped seal including: first and second opposing members and a central member separating the first and second opposing members, the central member defining first and second fluid cavities.

F. A method for manufacturing and accessing a well system, the method including: 1) forming a first wellbore and a secondary wellbore within a subterranean formation, the secondary wellbore extending from the first wellbore; 2) positioning wellbore casing in the first wellbore, the wellbore casing having a casing window connecting an interior of the wellbore casing and an exterior of the wellbore casing, the casing window located proximate a junction between the first wellbore and the secondary wellbore; and 3) positioning a downhole tool at the junction, the downhole tool including: a) an isolation system, the isolation system including: i) an elongated tubular, the elongated tubular having an opening connecting an interior of the elongated tubular and an exterior of the elongated tubular; ii) a slot located in the elongated tubular, the slot spanning the opening; iii) an isolation sleeve located within the isolation system; and iv) an I-shaped seal located in an annulus between the elongated tubular and the isolation sleeve, the I-shaped seal including: first and second opposing members and a central member separating the first and second opposing members, the central member defining first and second fluid cavities; and 4) sliding the isolation sleeve within the slot to either isolate the interior of the elongated tubular from the exterior of the elongated tubular or provide access between the interior of the elongated tubular and the exterior of the elongated tubular.

Aspects A, B, C, D, E and F may have one or more of the following additional elements in combination: Element 1: wherein the tubular forms at least a portion of an isolation system. Element 2: further including an isolation sleeve located within the isolation system, the isolation sleeve straddling the first and second I-shaped seals to isolate the interior of the tubular and the exterior of the tubular. Element 3: wherein the isolation sleeve is not a permanent fixture within the isolation system. Element 4: wherein the isolation sleeve is a permanent fixture within the isolation system. Element 5: wherein the tubular includes a slot for the isolation sleeve to slide within the isolation system when accessing or closing the opening. Element 6: wherein the tubular includes an uphole no-go profile and a downhole no-go profile, the uphole no-go profile and the downhole no-go profile preventing the isolation sleeve from sliding out of the isolation system. Element 7: wherein the isolation sleeve is configured to abut the uphole no-go profile when the isolation sleeve is isolating the interior of the tubular and the exterior of the tubular, and configured to abut the downhole no-go profile when the isolation sleeve is providing access between the interior of the tubular and the exterior of the tubular. Element 8: wherein the isolation sleeve is configured to abut the downhole no-go profile when the isolation sleeve is isolating the interior of the tubular and the exterior of the tubular, and configured to abut the uphole no-go profile when the isolation sleeve is providing access between the interior of the tubular and the exterior of the tubular. Element 9: wherein the tubular is a metal tubular, and the first and second I-shaped seals are first and second metal I-shaped seals, and further wherein the first and second metal I-shapes seals provide a metal-to-metal seal. Element 10: further including an isolation system positioned within the wellbore casing, the isolation system including an opening that at least partially aligns with the casing window. Element 11: wherein the first and second I-shaped seals are located in an annulus between the wellbore casing and the isolation system. Element 12: wherein the isolation system includes a slot for the isolation sleeve to slide to either isolate an interior of the isolation system from an exterior of the isolation system or provide access between the interior of the isolation system and the exterior of the isolation system. Element 13: wherein the isolation system includes an uphole no-go profile and a downhole no-go profile, the uphole no-go profile and the downhole no-go profile preventing the isolation sleeve from siding out of the isolation system. Element 14: wherein the isolation sleeve is configured to abut the uphole no-go profile when the isolation sleeve is isolating the opening, and configured to abut the downhole no-go profile when the isolation sleeve is providing access through the opening. Element 15: wherein the isolation sleeve is configured to abut the downhole no-go profile when the isolation sleeve is isolating the opening, and configured to abut the uphole no-go profile when the isolation sleeve is providing access through the opening. Element 16: wherein the isolation system is a metal isolation system, and the first and second I-shaped seals are first and second metal I-shaped seals, and further wherein the first and second metal I-shapes seals provide a metal-to-metal seal. Element 17: further including an isolation system positioned within the wellbore casing, the isolation system including an opening that at least partially aligns with the casing window. Element 18: wherein at least one of the one or more I-shaped seals is located in an annulus between the wellbore casing and the isolation system. Element 19: further including an isolation sleeve positioned within the isolation system, and wherein at least one of the one or more I-shaped seals is located in an annulus between the isolation system and the isolation sleeve. Element 20: further including an isolation sleeve positioned within the wellbore casing, and wherein at least one of the one or more I-shaped seals is located in an annulus between the wellbore casing and the isolation sleeve. Element 21: further including a secondary wellbore casing extending from the junction into the secondary wellbore, the secondary wellbore casing having a polished bore receptacle at the junction. Element 22: further including a straddle stimulation tool engaged within the polished bore receptacle, and further wherein at least one of the one or more I-shaped seals is located in an annulus between the polished bore receptacle and the straddle stimulation tool. Element 23: wherein the isolation sleeve is a permanent fixture within the isolation system. Element 24: wherein the elongated tubular includes an uphole no-go profile and a downhole no-go profile, the uphole no-go profile and the downhole no-go profile preventing the isolation sleeve from sliding out of the isolation system. Element 25: wherein the isolation sleeve is configured to abut the uphole no-go profile when the isolation sleeve is isolating the interior of the elongated tubular from the exterior of the elongated tubular, and configured to abut the downhole no-go profile when the isolation sleeve is providing access between the interior of the elongated tubular and the exterior of the elongated tubular. Element 26: wherein the isolation sleeve is configured to abut the downhole no-go profile when the isolation sleeve is isolating the interior of the elongated tubular from the exterior of the elongated tubular, and configured to abut the uphole no-go profile when the isolation sleeve is providing access between the interior of the elongated tubular and the exterior of the elongated tubular. Element 27: wherein the elongated tubular includes one or more profiles configured to engage with a collet in the isolation sleeve. Element 28: wherein the one or more profiles are configured to hold the isolation sleeve in place as well as act as an alignment feature. Element 29: wherein the I-shaped seal is a first I-shaped seal, and further including a second I-shaped seals located in the annulus between the elongated tubular and the isolation sleeve, the first and second I-shaped seals located on opposing sides of the opening, each of the first and second I-shaped seals including: the first and second opposing members; and the central member separating the first and second opposing members, the central member defining the first and second fluid cavities. Element 30: wherein the elongated tubular includes an uphole no-go profile and a downhole no-go profile, the uphole no-go profile and the downhole no-go profile preventing the isolation sleeve from sliding out of the isolation system. Element 31: wherein the isolation sleeve is configured to abut the uphole no-go profile when the isolation sleeve is isolating the interior of the elongated tubular from the exterior of the elongated tubular, and configured to abut the downhole no-go profile when the isolation sleeve is providing access between the interior of the elongated tubular and the exterior of the elongated tubular. Element 32: wherein the isolation sleeve is configured to abut the downhole no-go profile when the isolation sleeve is isolating the interior of the elongated tubular from the exterior of the elongated tubular, and configured to abut the uphole no-go profile when the isolation sleeve is providing access between the interior of the elongated tubular and the exterior of the elongated tubular.

Those skilled in the art to which this application relates will appreciate that other and further additions, deletions, substitutions and modifications may be made to the described embodiments.

What is claimed is:

1. A downhole tool, comprising:

an isolation system for placement at a junction between a first wellbore and a secondary wellbore, the isolation system including:

an elongated tubular, the elongated tubular having an opening connecting an interior of the elongated tubular and an exterior of the elongated tubular;

a slot located in the elongated tubular, the slot spanning the opening and having an uphole no-go profile and a downhole no-go profile;

an isolation sleeve located within the isolation system, the isolation sleeve configured to slide within the slot between the uphole no-go profile and the downhole no-go profile to either isolate the interior of the elongated tubular from the exterior of the elongated tubular or provide access between the interior of the elongated tubular and the exterior of the elongated tubular, the uphole no-go profile and the downhole no-go profile preventing the isolation sleeve from sliding out of the isolation system; and an I-shaped seal located in an annulus between the elongated tubular and the isolation sleeve, the I-shaped seal including:

first and second opposing members; and a central member separating the first and second opposing members, the central member defining first and second fluid cavities, the central member and the first and second opposing members formed of a continuous piece of material, wherein the isolation sleeve is a permanent fixture within the isolation system.

2. The downhole tool as recited in claim 1, wherein the isolation sleeve is configured to abut the uphole no-go profile when the isolation sleeve is isolating the interior of the elongated tubular from the exterior of the elongated tubular, and configured to abut the downhole no-go profile when the isolation sleeve is providing access between the interior of the elongated tubular and the exterior of the elongated tubular.

3. The downhole tool as recited in claim 1, wherein the isolation sleeve is configured to abut the downhole no-go profile when the isolation sleeve is isolating the interior of the elongated tubular from the exterior of the elongated tubular, and configured to abut the uphole no-go profile when the isolation sleeve is providing access between the interior of the elongated tubular and the exterior of the elongated tubular.

4. The downhole tool as recited in claim 1, wherein the elongated tubular includes one or more profiles configured to engage with a collet in the isolation sleeve.

5. The downhole tool as recited in claim 4, wherein the one or more profiles are configured to hold the isolation sleeve in place as well as act as an alignment feature.

6. The downhole tool as recited in claim 1, wherein the I-shaped seal is a first I-shaped seal, and further including a second I-shaped seals located in the annulus between the elongated tubular and the isolation sleeve, the first and second I-shaped seals located on opposing sides of the opening, each of the first and second I-shaped seals including:

the first and second opposing members; and the central member separating the first and second opposing members, the central member defining the first and second fluid cavities.

7. A well system, comprising:

a first wellbore;

a secondary wellbore extending from the first wellbore;

wellbore casing located in the first wellbore, the wellbore casing having a casing window connecting an interior of the wellbore casing and an exterior of the wellbore casing, the casing window located proximate a junction between the first wellbore and the secondary wellbore; and a downhole tool positioned at the junction, the downhole tool including:

an isolation system, the isolation system including:

an elongated tubular, the elongated tubular having an opening connecting an interior of the elongated tubular and an exterior of the elongated tubular;

a slot located in the elongated tubular, the slot spanning the opening and having an uphole no-go profile and a downhole no-go profile;

an isolation sleeve located within the isolation system, the isolation sleeve configured to slide within the slot between the uphole no-go profile and the downhole no-go profile to either isolate the interior of the elongated tubular from the exterior of the elongated tubular or provide access between the interior of the elongated tubular and the exterior of the elongated tubular, the uphole no-go profile and the downhole no-go profile preventing the isolation sleeve from sliding out of the isolation system; and an I-shaped seal located in an annulus between the elongated tubular and the isolation sleeve, the I-shaped seal including:

first and second opposing members; and a central member separating the first and second opposing members, the central member defining first and second fluid cavities, the central member and the first and second opposing members formed of a continuous piece of material, wherein the isolation sleeve is a permanent fixture within the isolation system.

8. The well system as recited in claim 7, wherein the isolation sleeve is configured to abut the uphole no-go profile when the isolation sleeve is isolating the interior of the elongated tubular from the exterior of the elongated tubular, and configured to abut the downhole no-go profile when the isolation sleeve is providing access between the interior of the elongated tubular and the exterior of the elongated tubular.

9. The well system as recited in claim 7, wherein the isolation sleeve is configured to abut the downhole no-go profile when the isolation sleeve is isolating the interior of the elongated tubular from the exterior of the elongated tubular, and configured to abut the uphole no-go profile when the isolation sleeve is providing access between the interior of the elongated tubular and the exterior of the elongated tubular.

10. The well system as recited in claim 7, wherein the elongated tubular includes one or more profiles configured to engage with a collet in the isolation sleeve.

11. The well system as recited in claim 10, wherein the one or more profiles are configured to hold the isolation sleeve in place as well as act as an alignment feature.

12. The well system as recited in claim 7, wherein the I-shaped seal is a first I-shaped seal, and further including a second I-shaped seal located in the annulus between the elongated tubular and the isolation sleeve, the first and second I-shaped seals located on opposing sides of the opening, each of the first and second I-shaped seals including:

the first and second opposing members; and the central member separating the first and second opposing members, the central member defining the first and second fluid cavities.

13. A method for manufacturing and accessing a well system, comprising:

forming a first wellbore and a secondary wellbore within a subterranean formation, the secondary wellbore extending from the first wellbore;

positioning wellbore casing in the first wellbore, the wellbore casing having a casing window connecting an interior of the wellbore casing and an exterior of the wellbore casing, the casing window located proximate a junction between the first wellbore and the secondary wellbore; and positioning a downhole tool at the junction, the downhole tool including:

an isolation system, the isolation system including:

an elongated tubular, the elongated tubular having an opening connecting an interior of the elongated tubular and an exterior of the elongated tubular;

a slot located in the elongated tubular, the slot spanning the opening and having an uphole no-go profile and a downhole no-go profile;

an isolation sleeve located within the isolation system; and an I-shaped seal located in an annulus between the elongated tubular and the isolation sleeve, the I-shaped seal including:

first and second opposing members; and a central member separating the first and second opposing members, the central member defining first and second fluid cavities, the central member and the first and second opposing members formed of a continuous piece of material, wherein the isolation sleeve is a permanent fixture within the isolation system; and sliding the isolation sleeve within the slot between the uphole no-go profile and the downhole no-go profile to either isolate the interior of the elongated tubular from the exterior of the elongated tubular or provide access between the interior of the elongated tubular and the exterior of the elongated tubular, the uphole no-go profile and the downhole no-go profile preventing the isolation sleeve from sliding out of the isolation system.

14. The method as recited in claim 13, wherein the isolation sleeve is configured to abut the uphole no-go profile when the isolation sleeve is isolating the interior of the elongated tubular from the exterior of the elongated tubular, and configured to abut the downhole no-go profile when the isolation sleeve is providing access between the interior of the elongated tubular and the exterior of the elongated tubular.

15. The method as recited in claim 13, wherein the isolation sleeve is configured to abut the downhole no-go profile when the isolation sleeve is isolating the interior of the elongated tubular from the exterior of the elongated tubular, and configured to abut the uphole no-go profile when the isolation sleeve is providing access between the interior of the elongated tubular and the exterior of the elongated tubular.

16. The method as recited in claim 13, wherein the elongated tubular includes one or more profiles configured to engage with a collet in the isolation sleeve.

17. The method as recited in claim 16, wherein the one or more profiles are configured to hold the isolation sleeve in place as well as act as an alignment feature.

18. The method as recited in claim 13, wherein the I-shaped seal is a first I-shaped seal, and further including a second I-shaped seal located in the annulus between the elongated tubular and the isolation sleeve, the first and second I-shaped seals located on opposing sides of the opening, each of the first and second I-shaped seals including:

the first and second opposing members; and the central member separating the first and second opposing members, the central member defining the first and second fluid cavities.

19. A downhole tool, comprising:

an isolation system for placement at a junction between a first wellbore and a secondary wellbore, the isolation system including:

an elongated tubular, the elongated tubular having an opening connecting an interior of the elongated tubular and an exterior of the elongated tubular;

a slot located in the elongated tubular, the slot spanning the opening and having an uphole no-go profile and a downhole no-go profile;

an isolation sleeve located within the isolation system, the isolation sleeve configured to slide within the slot between the uphole no-go profile and the downhole no-go profile to either isolate the interior of the elongated tubular from the exterior of the elongated tubular or provide access between the interior of the elongated tubular and the exterior of the elongated tubular, the uphole no-go profile and the downhole no-go profile preventing the isolation sleeve from sliding out of the isolation system; and an I-shaped seal located in an annulus between the elongated tubular and the isolation sleeve, the I-shaped seal including:

first and second opposing members; and a central member separating the first and second opposing members, the central member defining first and second fluid cavities, the central member and the first and second opposing members formed of a continuous piece of material, wherein the isolation sleeve is configured to abut the uphole no-go profile when the isolation sleeve is isolating the interior of the elongated tubular from the exterior of the elongated tubular, and configured to abut the downhole no-go profile when the isolation sleeve is providing access between the interior of the elongated tubular and the exterior of the elongated tubular.

20. A downhole tool, comprising:

an isolation system for placement at a junction between a first wellbore and a secondary wellbore, the isolation system including:

an elongated tubular, the elongated tubular having an opening connecting an interior of the elongated tubular and an exterior of the elongated tubular;

a slot located in the elongated tubular, the slot spanning the opening and having an uphole no-go profile and a downhole no-go profile;

an isolation sleeve located within the isolation system, the isolation sleeve configured to slide within the slot between the uphole no-go profile and the downhole no-go profile to either isolate the interior of the elongated tubular from the exterior of the elongated tubular or provide access between the interior of the elongated tubular and the exterior of the elongated tubular, the uphole no-go profile and the downhole no-go profile preventing the isolation sleeve from sliding out of the isolation system; and an I-shaped seal located in an annulus between the elongated tubular and the isolation sleeve, the I-shaped seal including:

first and second opposing members; and a central member separating the first and second opposing members, the central member defining first and second fluid cavities, the central member and the first and second opposing members formed of a continuous piece of material, wherein the isolation sleeve is configured to abut the downhole no-go profile when the isolation sleeve is isolating the interior of the elongated tubular from the exterior of the elongated tubular, and configured to abut the uphole no-go profile when the isolation sleeve is providing access between the interior of the elongated tubular and the exterior of the elongated tubular.

21. A downhole tool, comprising:

an isolation system for placement at a junction between a first wellbore and a secondary wellbore, the isolation system including:

an elongated tubular, the elongated tubular having an opening connecting an interior of the elongated tubular and an exterior of the elongated tubular;

a slot located in the elongated tubular, the slot spanning the opening and having an uphole no-go profile and a downhole no-go profile;

an isolation sleeve located within the isolation system, the isolation sleeve configured to slide within the slot between the uphole no-go profile and the downhole no-go profile to either isolate the interior of the elongated tubular from the exterior of the elongated tubular or provide access between the interior of the elongated tubular and the exterior of the elongated tubular, the uphole no-go profile and the downhole no-go profile preventing the isolation sleeve from sliding out of the isolation system; and an I-shaped seal located in an annulus between the elongated tubular and the isolation sleeve, the I-shaped seal including:

first and second opposing members; and a central member separating the first and second opposing members, the central member defining first and second fluid cavities, the central member and the first and second opposing members formed of a continuous piece of material, wherein the elongated tubular includes one or more profiles configured to engage with a collet in the isolation sleeve.

* * * * *